US012497729B2

(12) United States Patent
Kim et al.

(10) Patent No.: US 12,497,729 B2
(45) Date of Patent: Dec. 16, 2025

(54) HANGER AND LAUNDRY TREATMENT APPARATUS INCLUDING THE SAME

(71) Applicant: LG Electronics Inc., Seoul (KR)

(72) Inventors: Daewoong Kim, Seoul (KR); Yeona Jo, Seoul (KR); Dongjun Choi, Seoul (KR); Hyunki Kim, Seoul (KR); Jeongguen Choi, Seoul (KR); Minkyu Oh, Seoul (KR); Yuna Jo, Seoul (KR); Jaemyung Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 521 days.

(21) Appl. No.: 17/979,102

(22) Filed: Nov. 2, 2022

(65) Prior Publication Data

US 2023/0138890 A1 May 4, 2023

(30) Foreign Application Priority Data

| | | |
|---|---|---|
| Nov. 2, 2021 | (KR) | 10-2021-0148504 |
| Nov. 2, 2021 | (KR) | 10-2021-0149168 |
| Nov. 2, 2021 | (KR) | 10-2021-0149169 |
| Sep. 26, 2022 | (KR) | 10-2022-0121808 |

(Continued)

(51) Int. Cl.

| | |
|---|---|
| ***D06F 57/00*** | (2006.01) |
| ***D06F 58/00*** | (2020.01) |
| ***D06F 58/10*** | (2006.01) |
| ***D06F 58/20*** | (2006.01) |
| ***D06F 73/02*** | (2006.01) |

(52) U.S. Cl.

CPC ..... *D06F 58/20* (2013.01); *D06F 57/00* (2013.01); *D06F 58/00* (2013.01); *D06F 58/10* (2013.01); *D06F 58/203* (2013.01); *D06F 73/02* (2013.01)

(58) Field of Classification Search

None

See application file for complete search history.

(56) References Cited

U.S. PATENT DOCUMENTS

| | | | |
|---|---|---|---|
| 11,377,782 | B2 | 7/2022 | Lee et al. |
| 2017/0145623 | A1 | 5/2017 | Jung et al. |

FOREIGN PATENT DOCUMENTS

| | | |
|---|---|---|
| CN | 108239868 | 7/2018 |
| CN | 110801142 | 2/2020 |

(Continued)

OTHER PUBLICATIONS

Extended European Search Report dated May 15, 2023 issued in Application No. 22204728.4.

(Continued)

*Primary Examiner* — Levon J Shahinian

(74) *Attorney, Agent, or Firm* — KED & ASSOCIATES, LLP

(57) ABSTRACT

A hanger may include a support body, a fastener to couple to the upper portion of the support body, an air supply device provided at the support body, and a moisture supply device provided at the support body. The air supply device may include a fan configured to suction and discharge air. The moisture supply device may include a moisture generator configured to provide moisture or steam. The fastener is disposed above the fan in a first direction, and the moisture generator is disposed below the fan in a second direction opposite to the first direction such that the fastener, the fan, and the moisture generator are disposed to overlap each other in the first direction.

30 Claims, 15 Drawing Sheets

(30) Foreign Application Priority Data

Sep. 26, 2022 (KR) ..... 10-2022-0121809
Oct. 7, 2022 (KR) ..... 10-2022-0128424

(56) References Cited

FOREIGN PATENT DOCUMENTS

| | | | |
|---|---|---|---|
| JP | 09-239199 | A | 9/1997 |
| JP | 10-000298 | A | 1/1998 |
| KR | 10-2013-0101773 | A | 9/2013 |
| KR | 10-180935 | B1 | 1/2018 |
| KR | 10-2019-0116093 | | 10/2019 |
| KR | 10-2020-0028182 | A | 3/2020 |

OTHER PUBLICATIONS

International Search Report dated Feb. 20, 2023 issued in Application PCT/KR2022/016668.
Korean Office Action dated Oct. 15, 2024, issued in Application No. 10-2022-0121809.

(a)

(b)

HANGER AND LAUNDRY TREATMENT APPARATUS INCLUDING THE SAME

This application claims the benefit of Korean Patent Application Nos. 10-2021-0148504, 10-2021-0149168 and 10-2021-0149169 all filed on Nov. 2, 2021; Korean Patent Application Nos. 10-2022-0121808 and 10-2022-0121809 both filed on Sep. 26, 2022; and Korean Patent Application No. 10-2022-0128424 filed on Oct. 7, 2022, which are hereby incorporated by reference as if fully set forth herein.

BACKGROUND

Field

The present disclosure relates to a hanger and a laundry treating apparatus including the same.

Discussion of the Related Art

Laundry treating apparatuses are apparatuses developed to wash and dry laundry or remove wrinkles from laundry at home or at a laundry shop. Laundry treating apparatuses are classified into a washing machine for washing laundry, a dryer for drying laundry, a washing/drying machine having both a washing function and a drying function, a laundry manager for refreshing laundry, a steamer for removing wrinkles from laundry, and the like.

Among the above apparatuses, the laundry manager is an apparatus that allows laundry to be kept tidy and clean. The laundry manager may remove fine dust attached to the laundry, deodorize the laundry, dry the laundry, and add fragrance to the laundry. In addition, the laundry manager may prevent generation of static electricity, remove wrinkles from the laundry using dehumidified air or steam, and sterilize the laundry.

Korean Patent Laid-Open Publication No. 10-2014-0108454, the subject matter or which is incorporated herein by reference, discloses a typical laundry treating apparatus. The laundry treating apparatus may include a chamber provided in a cabinet to define a space in which laundry is received, a door for opening or closing the chamber, a hanger support unit defining a space in which a hanger is supported inside the chamber, and a machine compartment in which devices for supplying at least one of steam or hot air to the chamber are provided.

In the laundry treating apparatus configured as described above, treatment of laundry (processes of drying the laundry, removing wrinkles from the laundry, and deodorizing the laundry by supplying at least one of steam or hot air to the laundry) is performed only in the chamber. That is, the laundry treating apparatus is not provided with a separate space for treatment of laundry other than the chamber.

Another laundry treating apparatus, which further has a function of supplying hot air or steam to a hanger, is disclosed (Korean Patent Laid-Open Publication No. 10-2016-0004539), the subject matter or which is incorporated herein by reference. This hanger-type laundry treating apparatus includes a fan/heater assembly for supplying hot air, a steam generator for supplying steam, and a water supply tank for supplying water to the steam generator.

In the above-described hanger-type laundry treating apparatus, the fan, the heater, the steam generator, and the water supply tank are disposed such that a straight line passing through the centers of gravity of the fan and the heater intersects a straight line passing through the centers of gravity of the steam generator and the water supply tank.

The hanger-type laundry treating apparatus, in which a straight line passing through the centers of gravity of the fan and the heater is orthogonal to a straight line passing through the centers of gravity of the steam generator and the water supply tank, may have a problem that the hanger does not maintain a horizontal orientation when the amount of water in the water supply tank is reduced or when the amount of water in the steam generator is reduced. That is, because the steam generator and the water supply tank are disposed in the width direction of the hanger, the weights of the two opposite sides may become different from each other.

SUMMARY

A technical task of the present disclosure is to provide a hanger capable of supplying moisture or air (heated air or non-heated air) to laundry and a laundry treating apparatus including the hanger.

In addition, a technical task of the present disclosure is to provide a hanger capable of being detachably mounted in a laundry treating apparatus and capable of independently supplying moisture or air to laundry even when the same is separated from the laundry treating apparatus.

In addition, a technical task of the present disclosure is to provide a hanger capable of maintaining a horizontal orientation by minimizing change in the center of gravity thereof during supply of moisture to laundry and a laundry treating apparatus including the hanger.

In addition, a technical task of the present disclosure is to provide a laundry treating apparatus including a cabinet chamber, which is provided in a cabinet to define a space for treatment of laundry, and a door chamber, which is provided in a door for opening or closing the cabinet chamber to define a space for treatment of laundry.

In addition, a technical task of the present disclosure is to provide a hanger, which is provided in the cabinet chamber or the door chamber to define a space in which laundry is supported.

In addition, a technical task of the present disclosure is to provide a hanger capable of preventing laundry from blocking an air exhaust hole for supplying air and a discharge hole for supplying moisture and a laundry treating apparatus including the hanger.

The present disclosure provides a hanger including a support body, which includes a base, a first support surface and a second support surface located at positions symmetrical with each other with respect to the base, and a connection surface connecting the base to the support surfaces, an air intake hole formed in the connection surface to introduce air into the support body, an air exhaust hole formed in each of the first support surface and the second support surface to discharge air, a discharge hole formed in each of the first support surface and the second support surface to discharge moisture, an air flow path provided in the support body to interconnect the air intake hole and the air exhaust hole, a moisture flow path provided in the support body and connected to the discharge hole, a fan configured to suction air through the air intake hole, a moisture generator configured to supply heated steam or non-heated steam to the moisture flow path, a first spacer secured to the support body to provide a laundry support space and maintain a predetermined interval between laundry and the first support surface, and a second spacer secured to the support body to provide a laundry support space and maintain a predetermined interval between laundry and the second support surface.

The first spacer may include a first seating body configured to support laundry, a first fixed portion configured to secure the first seating body to the first support surface, and a first-seating-body through-hole formed through the first seating body to form a passage allowing fluid to pass therethrough. The second spacer may include a second seating body configured to support laundry, a second fixed portion configured to secure the second seating body to the second support surface, and a second-seating-body through-hole formed through the second seating body to form a passage allowing fluid to pass therethrough.

The hanger may further include a first upper support portion connecting the upper end of the first seating body to the first support surface to support a part of laundry and a second upper support portion connecting the upper end of the second seating body to the second support surface to support another part of the laundry.

The air intake hole may be located between the first upper support portion and the second upper support portion.

The air intake hole may have an uppermost end located above a line interconnecting the first upper support portion and the second upper support portion.

In addition, the air intake hole may have a lowermost end located below the line interconnecting the first upper support portion and the second upper support portion.

The fan may include an impeller provided in the support body to suction external air to the air intake hole and an impeller motor configured to rotate the impeller.

In addition, the hanger may further include a heater provided in the support body to heat air that has passed through the air intake hole.

The moisture generator may be located in the support body at a position lower than the fan.

The center of gravity of the fan and the center of gravity of the moisture generator may be located between the boundary between the base and the first support surface and the boundary between the base and the second support surface.

The center of gravity of the heater may be located between the boundary between the base and the first support surface and the boundary between the base and the second support surface.

The hanger may further include a fastening unit secured to the base to allow the support body to be detachably secured to an external device. The point at which the fastening unit is secured to the base, the center of gravity of the heater, the center of gravity of the fan, and the center of gravity of the moisture generator may be disposed in a straight line.

The hanger may further include a fastening-unit terminal provided in the fastening unit and connected to a power supply in order to supply power to the impeller motor, the moisture generator, and the heater.

The hanger may further include a supply tank removably provided in the support body to define a space storing water. The supply tank may be connected to the moisture generator when the supply tank is secured to the support body. The center of gravity of the supply tank may be located between the boundary between the base and the first support surface and the boundary between the base and the second support surface.

The first support surface may include a first top surface secured to the base to support a part of laundry and a first side surface extending from the first top surface, and the second support surface may include a second top surface secured to the base to support another part of the laundry and a second side surface extending from the second top surface.

The air exhaust hole may include a first air exhaust hole formed in each of the first top surface and the second top surface and a second air exhaust hole formed in each of the first side surface and the second side surface.

The discharge hole may include a first discharge hole formed in each of the first top surface and the second top surface and a second discharge hole formed in each of the first side surface and the second side surface.

The hanger may further include a bottom surface interconnecting the first side surface, the second side surface, and the connection surface.

The air exhaust hole may further include a third air exhaust hole formed through the bottom surface, and the discharge hole may further include a third discharge hole formed through the bottom surface.

The hanger may further include an air supply body secured in the support body and having the air flow path, an air-intake-hole connection portion formed through the air supply body and connecting the air intake hole to the air flow path, a first air-exhaust-hole communication hole formed through the air supply body and connecting the air flow path to the first air exhaust hole, a second air-exhaust-hole communication hole connecting the air flow path to the second air exhaust hole, and a third air-exhaust-hole communication hole connecting the air flow path to the third air exhaust hole.

In addition, the hanger may further include a moisture supply body secured in the support body and having the moisture flow path, a first discharge-hole communication hole formed through the moisture supply body and connecting the moisture flow path to the first discharge hole, a second discharge-hole communication hole connecting the moisture flow path to the second discharge hole, and a third discharge-hole communication hole connecting the moisture flow path to the third discharge hole.

In addition, the hanger may further include a generator accommodating portion provided in the moisture supply body to accommodate the moisture generator, a tank accommodating portion provided in the air supply body to accommodate the supply tank, and a tank mounting portion having a passage penetrating the connection surface to allow the supply tank to be inserted into the tank accommodating portion therethrough.

In addition, the hanger may further include a drain hole discharging water in the supply tank, a check valve configured to control opening and closing of the drain hole, and a supply flow path provided therein with an actuator configured to operate the check valve to open the drain hole when the supply tank is inserted into the tank accommodating portion, a connection pipe connecting the actuator to the moisture generator, and a connection-pipe valve configured to control opening and closing of the connection pipe.

The air exhaust hole may have a size larger than the size of the discharge hole.

At least a portion of the air intake hole may be located higher than the air exhaust hole.

At least a portion of the air intake hole may be located higher than the discharge hole.

The fan may be located closer to the air intake hole than to the air exhaust hole. In addition, the fan may be provided in the support body, and at least a portion of the fan may be located higher than the air exhaust hole.

The air exhaust hole formed in each of the first support surface and the second support surface may be provided in plural, and the discharge hole formed in each of the first support surface and the second support surface may be provided in plural. The plurality of air exhaust holes located in the first support surface and the plurality of discharge holes located in the first support surface may be arranged parallel to each other in a direction from the first support surface toward the base, and the plurality of air exhaust holes located in the second support surface and the plurality of discharge holes located in the second support surface may be arranged parallel to each other in a direction from the second support surface toward the base.

The connection surface may include a first connection surface and a second connection surface connecting the base to the first support surface and to the second support surface to respectively form a front surface and a rear surface of the support body.

The air intake hole may pass through the first connection surface.

The air exhaust hole may be located closer to the first connection surface than the discharge hole.

The present disclosure provides a laundry treating apparatus including a cabinet, which includes a cabinet chamber defining a space receiving laundry and a cabinet inlet allowing the cabinet chamber to communicate with the outside, a supply unit configured to supply at least one of air or steam to the cabinet chamber, a first door configured to open or close the cabinet inlet, a door chamber provided in the first door to define a space receiving laundry, a second door configured to open or close the door chamber, and a hanger removably provided in the cabinet chamber or the door chamber. The hanger includes a support body, which includes a base, a first support surface and a second support surface located at positions symmetrical with each other with respect to the base, and a connection surface connecting the base to the support surfaces, a fastening unit coupled to the upper portion of the support body to hang the support body, an air intake hole formed in the connection surface to introduce air into the support body, an air exhaust hole formed in each of the first support surface and the second support surface to discharge air, a discharge hole formed in each of the first support surface and the second support surface to discharge moisture, an air flow path provided in the support body to interconnect the air intake hole and the air exhaust hole, a moisture flow path provided in the support body and connected to the discharge hole, a fan configured to suction air through the air intake hole, a moisture generator configured to supply heated steam or non-heated steam to the moisture flow path, a first spacer secured to the support body to provide a laundry support space and maintain a predetermined interval between laundry and the first support surface, and a second spacer secured to the support body to provide a laundry support space and maintain a predetermined interval between laundry and the second support surface.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

A hanger and a laundry treating apparatus including the same according to an embodiment may be described with reference to the accompanying drawings.

Unless otherwise defined, all terms used herein have the same meanings as those generally appreciated by those skilled in the art. The terms, such as ones defined in common dictionaries, should be interpreted as having the same meanings as terms in the context of pertinent technology, and should not be interpreted as having ideal or excessively formal meanings unless clearly defined in the specification.

Figure 1:
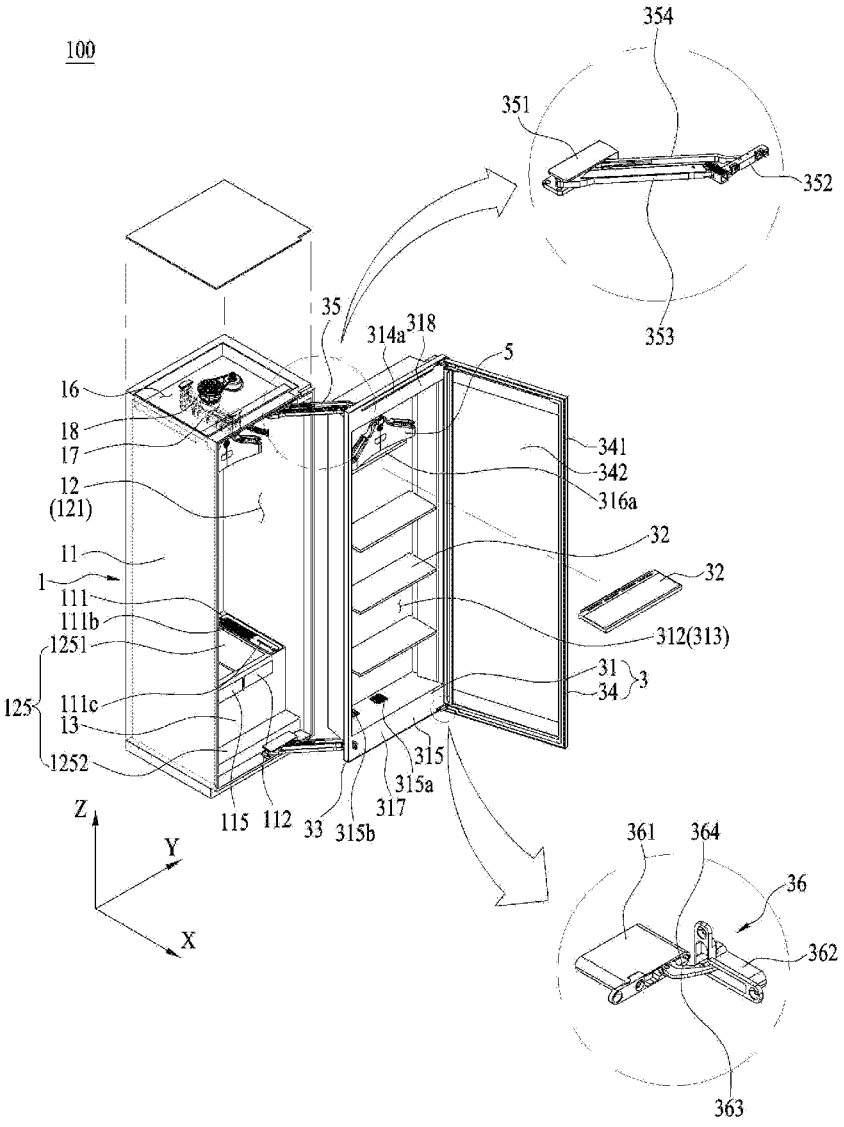
FIG. 1 shows examples of a hanger and a laundry treating apparatus including the same.

As shown in FIG. 1, a laundry treating apparatus 100 includes a main body 1 that has formed therein a cabinet chamber 12 defining a laundry treatment space, a door 3 that is configured to open or close the cabinet chamber 12 and has formed therein a door chamber 312 defining a laundry treatment space isolated from the cabinet chamber 12, and a hanger 5 that is provided in the cabinet chamber 12 or the door chamber 312 to support laundry. Treatment of laundry means processes of drying the laundry, removing wrinkles from the laundry, and/or deodorizing the laundry by supplying air (heated air or non-heated air) or moisture (heated steam or non-heated steam) to the laundry, and the laundry treatment space means a space in which the aforementioned treatment processes are performed. The cabinet chamber 12 may be provided as a treatment space only for treatment of the laundry, and the door chamber 312 may be provided as a space for at least one of treatment of the laundry or exhibition of the laundry.

The main body 1 includes a cabinet 11 in which the cabinet chamber 12 is formed. The cabinet chamber 12 communicates with the outside of the cabinet 11 through a cabinet inlet 121 formed through one surface of the cabinet 11. Therefore, a user may introduce laundry (an example of objects to be treated) into the cabinet chamber 12 through the cabinet inlet 121.

A cabinet-chamber bottom surface 125, which forms the bottom surface of the cabinet chamber 12, may be formed in a stepped shape. That is, the cabinet-chamber bottom surface 125 may include a first bottom surface 1251 that forms a bottom surface of a region under which a first machine compartment 13 is located, and a second bottom surface 1252 that forms a bottom surface of a region in which at least a portion of the door chamber 312 is received when the door 3 closes the cabinet chamber 12.

Therefore, laundry may be received and managed in a region above the first bottom surface 1251 among the regions in the cabinet chamber 12. Additionally, when the door 3 closes the cabinet chamber 12, at least a portion of the door chamber 312 may be received in the cabinet chamber 12, and the door chamber 312 may be located in front of the first machine compartment 13 and the region in the cabinet chamber 12 that is located above the first machine compartment.

Therefore, a length between the top surface of the cabinet chamber 12 and the first bottom surface 1251 may be shorter than the length of the door chamber 312. Accordingly, the length of laundry received in the door chamber 312 may be longer than the length of laundry received in the cabinet chamber 12.

Meanwhile, the length of the first bottom surface 1251 in the forward-backward direction may be longer than the length of the second bottom surface 1252 in the forward-backward direction. Therefore, a greater number of laundry articles may be hung in the cabinet chamber 12 than in the door chamber 312. The reason for this is not only to enable management of the laundry by selecting one or all of the two chambers according to the number of laundry articles, but also to prevent the laundry treating apparatus 100 from falling over due to the weight of the door 3.

Figure 2:
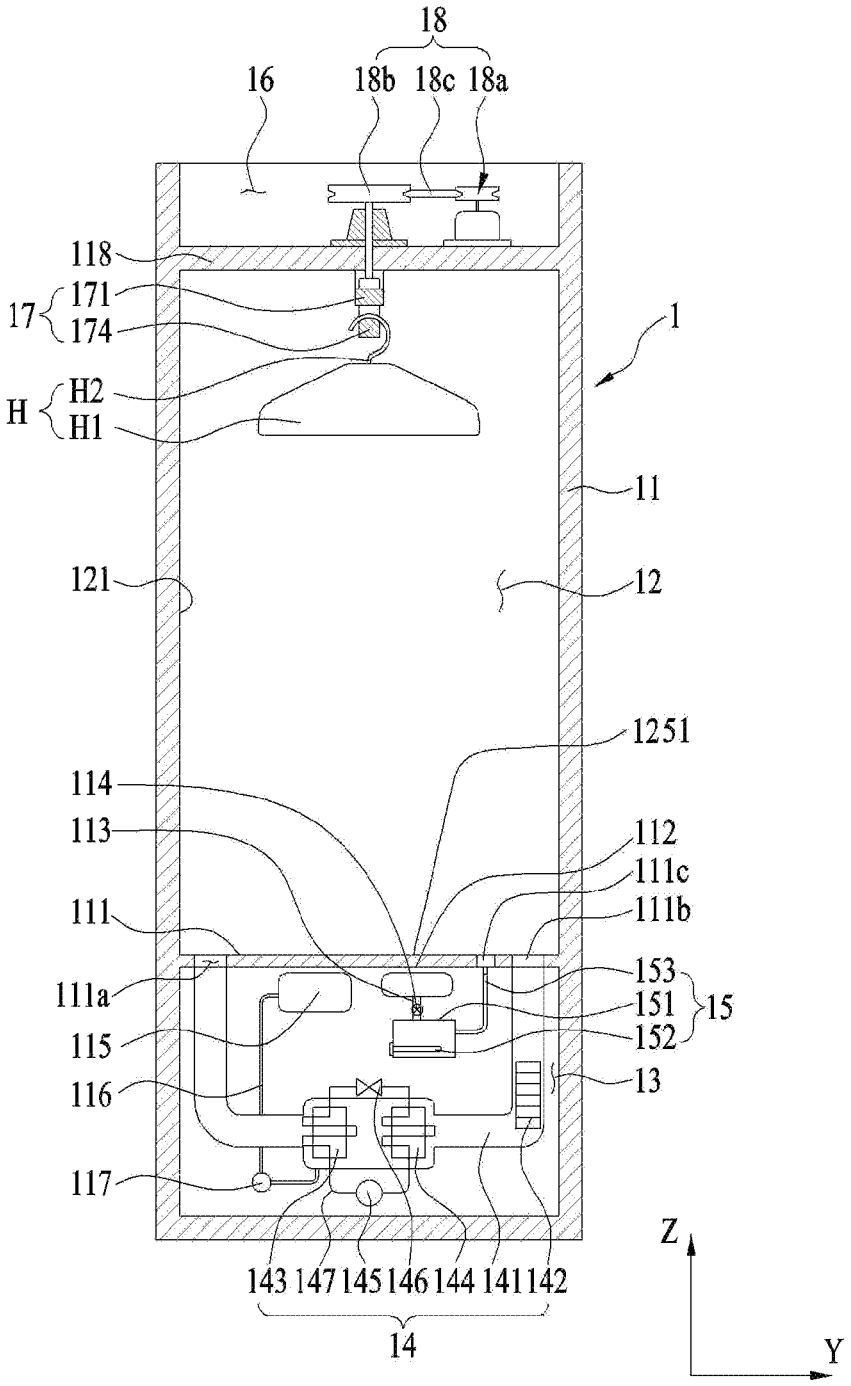
FIG. 2 shows examples of a first machine compartment, a second machine compartment, and a cabinet chamber provided in the laundry treating apparatus.

As shown in FIG. 2, the main body 1 may include a first partition wall 111 and a second partition wall 118 for partitioning the inner space in the cabinet 11.

The first partition wall 111 may be provided to partition the inner space in the cabinet into the first machine compartment 13 and the cabinet chamber 12, and the second partition wall 118 may be provided to partition the inner space in the cabinet into a second machine compartment 16 and the cabinet chamber 12. Alternatively, the cabinet chamber 12 may be provided in the cabinet 11, the first machine compartment 13 may be formed between the bottom surface of the cabinet 11 and the cabinet-chamber bottom surface 125, and the second machine compartment 16 may be formed between the top surface of the cabinet 11 and the top surface of the cabinet chamber 12. That is, the first partition wall 111 may be the bottom surface of the cabinet chamber 12, and the second partition wall 118 may be the top surface of the cabinet chamber 12.

The first machine compartment 13 may be located below the cabinet chamber 12 to define a space in which supply units 14 and 15 are mounted, and the second machine compartment 16 may be located above the cabinet chamber 12 to define a space in which a driving unit 18 is mounted. The first partition wall 111 may form the bottom surface of the cabinet chamber 12 and the top surface of the first machine compartment 13, and the second partition wall 118 may form the top surface of the cabinet chamber 12 and the bottom surface of the second machine compartment 16.

That is, the laundry treating apparatus 100 may include the cabinet 11 having the cabinet inlet 121 formed in the front surface thereof, the cabinet chamber 12 located in the cabinet to receive laundry or an item, the door 3 for opening or closing the cabinet inlet 121, the first machine compartment 13 located in the lower region in the cabinet to define a space isolated from the cabinet chamber 12, and the door chamber 312 located in the door 3 to receive laundry or an item.

Additionally, when the door 3 closes the cabinet inlet 121, at least a portion of the door chamber 312 may be located in front of the first machine compartment 13 in the cabinet chamber 12.

Therefore, considering the stepped bottom surface of the cabinet chamber 12, a hanger support unit 17 may be located above the first bottom surface 1251 so as to be spaced apart from the first bottom surface 1251, and at least a portion of the door chamber 312 may be located above the second bottom surface 1252.

Accordingly, when the door 3 closes the cabinet inlet 121, the second bottom surface 1252 may face at least a portion of the door 3.

Additionally, the door chamber 312 may be located in front of the second machine compartment 16 in the cabinet chamber 12.

The reason why the first machine compartment 13 is located in a rear region in the cabinet chamber 12 is to provide a balance against the weight of the door 3. That is, when the door 3 is pulled forward to open the cabinet inlet 121, there is a risk of the laundry treating apparatus 100 falling over due to the weight of the door 3. Therefore, in order to prevent this problem, it may be preferable for the first machine compartment 13 to be located in a rear region in the cabinet chamber 12.

The height of the door chamber 312 may be greater than the height of the region in which the first bottom surface 1251 is located among the regions in the cabinet chamber 12. The reason for this is to allow laundry longer than laundry that can be received in the cabinet chamber 12 to be received in the door chamber 312.

If the height of the door chamber 312 is less than the height of the region in which the first bottom surface 1251 is located among the regions in the cabinet chamber 12 and the door chamber 312 takes the form of an auxiliary box that is provided in a portion of the door 3 so as to intrude toward the cabinet chamber 12, laundry that can be received in the cabinet chamber 12 may not be received in the auxiliary box. In addition, because the auxiliary box intrudes into the cabinet chamber 12, the auxiliary box may hinder circulation of air through a first supply unit 14, which will be described below. Therefore, it may be preferable that the door chamber 312 be provided in the door 3 and that the rear surface of the door 3 be of a flat surface form. In addition, in order to use the inner space in the door 3 to the maximum extent, the length of the door chamber 312 may be greater than the height of the region in which the first bottom surface 1251 is located among the regions in the cabinet chamber 12.

The supply units 14 and 15 are provided to supply at least one of air or moisture to the cabinet chamber 12. FIG. 2 illustrates a configuration in which the supply units include a first supply unit 14 (or first supply device) for supplying air to the cabinet chamber 12 and a second supply unit 15 (or second supply device) for supplying moisture to the cabinet chamber 12.

The first supply unit 14 may be configured to supply heated air (hot air) to the cabinet chamber 12. Alternatively, the first supply unit 14 may be configured to supply non-heated air to the cabinet chamber 12. FIG. 2 shows the configuration of the former by way of example.

The second supply unit 15 may be configured to supply heated steam or non-heated steam (mist or the like) to the cabinet chamber 12. FIG. 2 shows the configuration of the second supply unit 15 for supplying heated steam to the cabinet chamber 12 by way of example.

The main body 1 may have an air suction hole 111*a*, an air supply hole 111*b*, and a moisture supply hole 111*c* formed through the first partition wall 111 to allow the cabinet chamber 12 and the first machine compartment 13 to communicate with each other therethrough.

In this example, the first supply unit 14 may include a duct 141 that is located between the air suction hole 111*a* and the air supply hole 111*b* so as to be connected thereto to form an air flow path, a duct fan 142 that causes air to move through the duct 141, and a heat-exchanging unit (a first heat-exchanging unit/device), that sequentially dehumidifies and heats the air introduced into the duct 141.

The first heat-exchanging unit (or a cabinet heat-exchanging unit 143, 144, 145, 146, and 147) includes a heat absorber 143 that absorbs heat from the air introduced into the duct 141 to condense the air, and a heat generator 144 that supplies heat to the air that has passed through the heat absorber to heat the air. The heat absorber 143 and the heat generator 144 may be connected to each other via a refrigerant pipe 147 that forms a refrigerant circulation path. A compressor 145 that causes refrigerant to move through the refrigerant pipe, and a pressure regulator 146 that regulates the pressure of the refrigerant circulating through the refrigerant pipe, are provided in the refrigerant pipe 147.

The second supply unit 15 may include a reservoir 151 that is provided in the first machine compartment 13 to store water therein, a steam heater 152 that is provided in the reservoir to heat water, and a supply pipe 153 that guides steam in the reservoir 151 to the moisture supply hole 111*c*. The steam heater 152 may be embodied as an electric resistor (a heating element) that generates heat upon receiving power.

The second supply unit 15 receives water from a water supply tank 112, and condensed water discharged from the heat absorber 143 is stored in a water drain tank 115.

Referring to FIGS. 1 and 2, the water supply tank 112 and the water drain tank 115 may be placed into or removed from the first machine compartment 13 through the front surface of the first machine compartment 13. That is, the water supply tank 112 may be formed as a drawer type, and may be inserted into the first machine compartment 13 to be connected to a water supply path 113, which will be described below. In addition, the water drain tank 115 may also be formed as a drawer type, and may be inserted into the first machine compartment 13 to be connected to a water drain path 116, which will be described later.

The water supply tank 112 may be connected to the reservoir 151 via the water supply path 113, and a water supply valve 114 may be provided in the water supply path 113. The water drain tank 115 may be connected to the duct 141 via the water drain path 116, and condensed water stored in the duct 141 may move to the water drain tank 115 through a pump 117.

A hanger controller for supporting a hanger H (or a cabinet hanger) may be provided in the cabinet chamber 12.

The cabinet hanger H may include a laundry support portion H1 for supporting laundry and a fastening hook H2 fixed to the laundry support portion. The hanger controller may include a hanger support unit 17 that supports the fastening hook H2, and a driving unit 18 that enables the hanger support unit 17 to move in the cabinet chamber 12.

The hanger support unit 17 may be located in the cabinet chamber 12, and the driving unit 18 may be provided in the second machine compartment 16.

Figure 3:
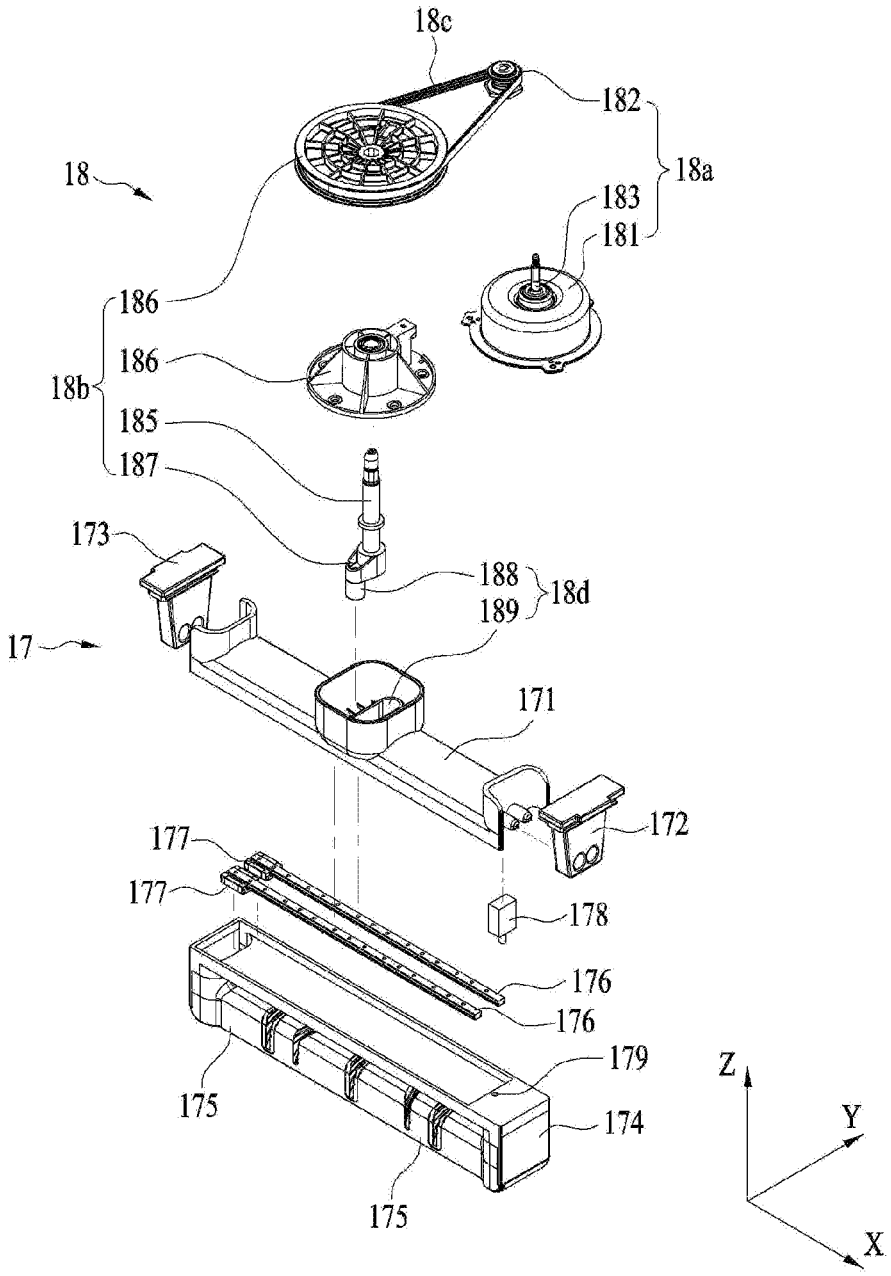
FIGS. 3 and 4 show an example of a hanger support unit.

As shown in FIG. 3, the hanger support unit 17 may include a first body 171 that is vibrated by the driving unit 18, and a second body 174 that is coupled to the first body 171 so as to be movable toward the cabinet inlet 121.

The first body 171 may be formed in the shape of a bar that extends in a depth direction of the cabinet chamber 12 (i.e., the X-axis direction). The first body 171 may be connected to the second partition wall 118 via a first connection body 172 and a second connection body 173. That is, the first connection body 172 may connect one end of the first body 171 to the second partition wall 118, and the second connection body 173 may connect the other end of the first body 171 to the second partition wall 118.

The first connection body 172 and the second connection body 173 may be made of an elastic material, such as rubber, so that the first body 171 moves in the depth direction of the cabinet chamber 12 (i.e., the X-axis direction) when the driving unit 18 operates.

Figure 4:
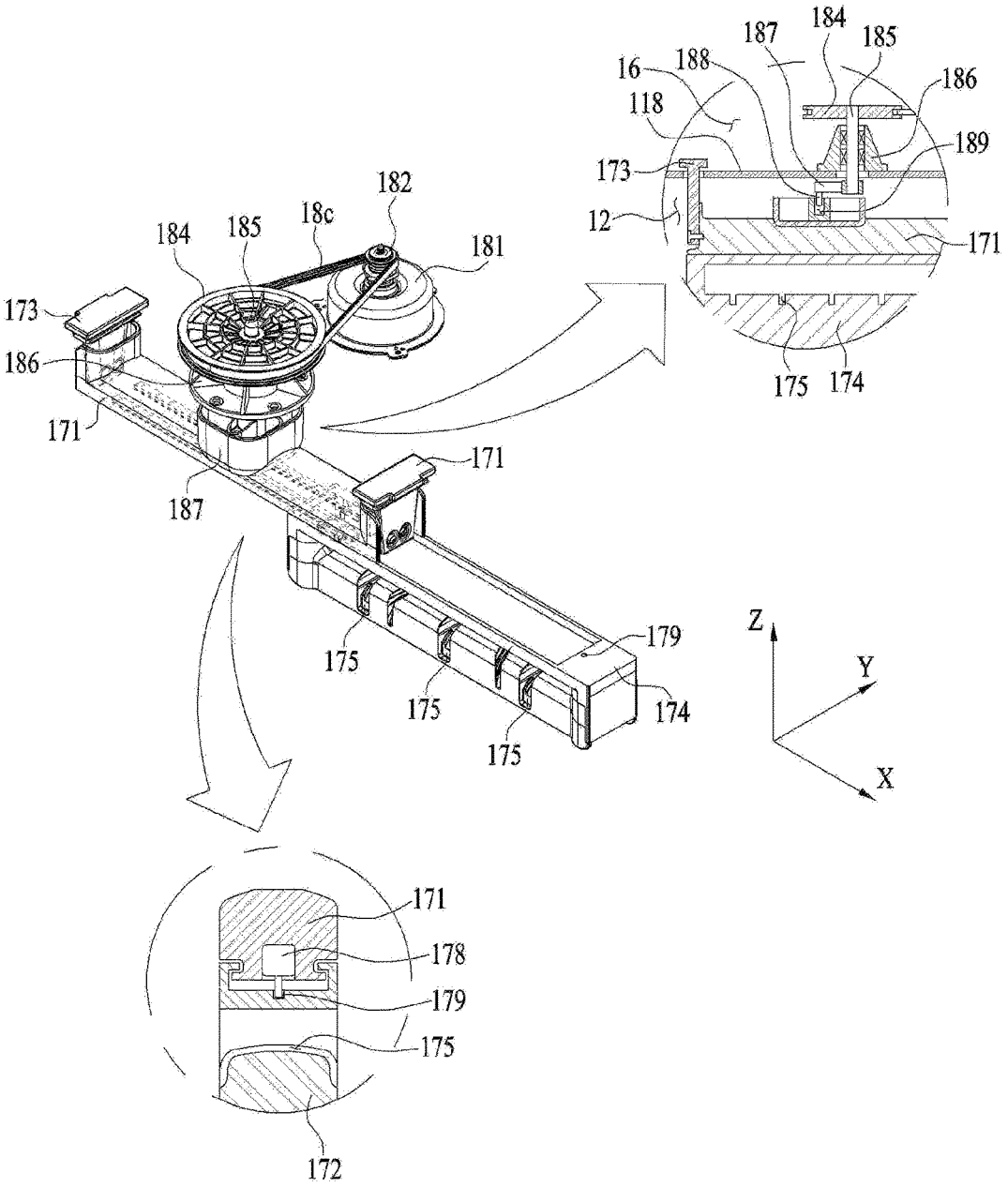

The second body 174 may be coupled to the first body 171 via a body guide 176 and 177. The body guide may include a rail 176 that is fixed to the first body 171, and a block 177 that is fixed to the second body 174. The block 177 is coupled to the rail 176 so as to be movable along the rail 176. Accordingly, as shown in FIG. 4, the second body 174 may be moved out of the cabinet chamber 12 by the body guide (including the rail 176 and/or the block 177). Since the second body 174 is movable out of the cabinet chamber 12, it is convenient to suspend the cabinet hanger H from the second body 174 or to remove the cabinet hanger H from the second body 174.

Similar to the first body 171, the second body 174 may be formed in the shape of a bar that extends in the depth direction of the cabinet chamber 12 (i.e., the X-axis direction), and may have a hook receiving recess 175 formed in the upper surface thereof to receive the fastening hook H2 therein.

When the first body 171 and the second body 174 are disposed in the depth direction of the cabinet chamber 12, the air supply hole 111*b* formed in the first partition wall 111 may be embodied as a slit that extends in the depth direction of the cabinet chamber 12. The reason for this is to supply air to a relatively wide surface of the laundry. For the same reason, each of the air suction hole 111*a* and the moisture supply hole 111*c* may also be embodied as a slit that extends in the depth direction of the cabinet chamber 12.

Referring to FIG. 2, the air suction hole 111*a* and the air supply hole 111*b* may be disposed in the width direction of the cabinet 11. Meanwhile, the direction in which the hanger support unit 17 extends, specifically the direction in which the first body 171 or the second body 172 extends, may be the forward-backward direction or the depth direction of the cabinet 11.

Accordingly, the air discharged from the air supply hole 111*b*, which extends in the forward-backward direction of the cabinet 11, may be uniformly supplied to gaps between the laundry articles suspended from the hanger support unit 17.

Additionally, circulation of air in the cabinet chamber 12 is less likely to be disturbed by the laundry suspended from the hanger support unit 17.

As shown in FIG. 3, the driving unit 18 may include a driving module 18*a* fixedly mounted in the second machine compartment 16, a driven module 18*b* connected to the driving module 18*a* via a belt 18*c*, and a converting module 18*d* for transmitting the rotational movement of the driven module 18*b* to the first body 171.

As shown in FIG. 4, the driving module 18*a* may include a motor 181 fixedly mounted in the second machine compartment 16 and a driving pulley 182 fixed to the rotary shaft 183 (or the motor shaft) of the motor.

The driven module 18*b* may include a rotary shaft 185 that is disposed so as to pass through the second partition wall 118, a driven pulley 184 that is located in the second machine compartment 16 to be fixed to one end of the rotary shaft, and an arm 187 that is located in the cabinet chamber 12 to be fixed to the other end of the rotary shaft. In order to support the rotary shaft 185, a shaft support member 186 (or a bearing housing) may be disposed on the second partition wall 118.

The driving pulley 182 and the driven pulley 184 are connected to each other via the belt 18*c*. However, when the driving pulley is replaced with a driving gear fixed to the motor shaft 183 and the driven pulley is replaced with a driven gear fixed to the rotary shaft 185 and engaged with the driving gear, the belt may be omitted.

The converting module 18*d* may include a guide member 189 that takes the form of a recess or a slot formed in the first body 171, and a guide-member coupling portion 188 that is provided at the free end of the arm 187 to be inserted into the guide member 189.

The guide member 189 may extend in the width direction of the cabinet chamber 12 (i.e., the Y-axis direction or the direction perpendicular to the first body) (the guide member may extend in the depth direction of the cabinet chamber 12). The length of the guide member 189 may be set to be greater than or equal to the diameter of the rotation track formed by the guide-member coupling portion 188. In this example, when the driving unit 18 operates, the first body 171, the second body 174, and the cabinet hanger H may perform reciprocating movement in the depth direction of the cabinet chamber 12 (i.e., the X-axis direction). However, movement thereof in the width direction of the cabinet chamber 12 may be regulated. That is, the circular movement of the driving unit 18 may be converted into reciprocating movement of the hanger support unit 17 in the forward-backward direction or the depth direction of the cabinet chamber 12.

If the second body 174 is not fixed to the first body 171, there is a risk of the second body 174 being damaged due to collision with the cabinet 11 or the door 13 when the hanger support unit 17 performs reciprocating movement in the forward-backward direction of the cabinet 11. In order to prevent this problem, the hanger support unit 17 may include a stopper 178 for securing the second body 174 to the first body 171.

FIGS. 3 and 4 illustrate an example in which the second body 174 is provided with a protrusion receiving portion 179 that is coupled to the stopper 178. The stopper 178 may include a motor and a protrusion that is inserted into the protrusion receiving portion 179 or is separated from and moved away from the protrusion receiving portion 179 by the motor. The protrusion receiving portion 179 may be formed in the shape of a recess that receives the protrusion therein.

The user may hang the hanger in the hook receiving recess 175 after drawing the second body 174 forward, and then may move the second body 174 backwards to the original position thereof using the body guide 176 and 177. Thereafter, the user may close the door 3. In this example, a controller may detect closing of the cabinet chamber 12, and may control the stopper 178 such that the protrusion moves into the protrusion receiving portion 179, thereby fixing the second body 174. Upon detecting opening of the door 3, the controller may perform control such that the protrusion is separated from the protrusion receiving portion 179, whereby the second body 174 may enter a state in which the second body 174 can be drawn forward.

FIG. 4 shows a state in which the second body 174 is drawn forward. The enlarged cross-sectional view in the lower side in FIG. 4 shows a state in which the first body 171 and the second body 174 are coupled to each other by the stopper 178 when the cabinet chamber 12 is closed by the door 3.

As shown in FIG. 1, the cabinet chamber 12 is opened or closed by the door 3.

The door 3 may include a first door 31 that is secured to the cabinet 11 by means of a first hinge 35 to open or close the cabinet inlet 121, and a second door 34 that is secured to the first door 31 by means of a second hinge 36 to open or close the door chamber 312 provided in the first door.

Figure 5:
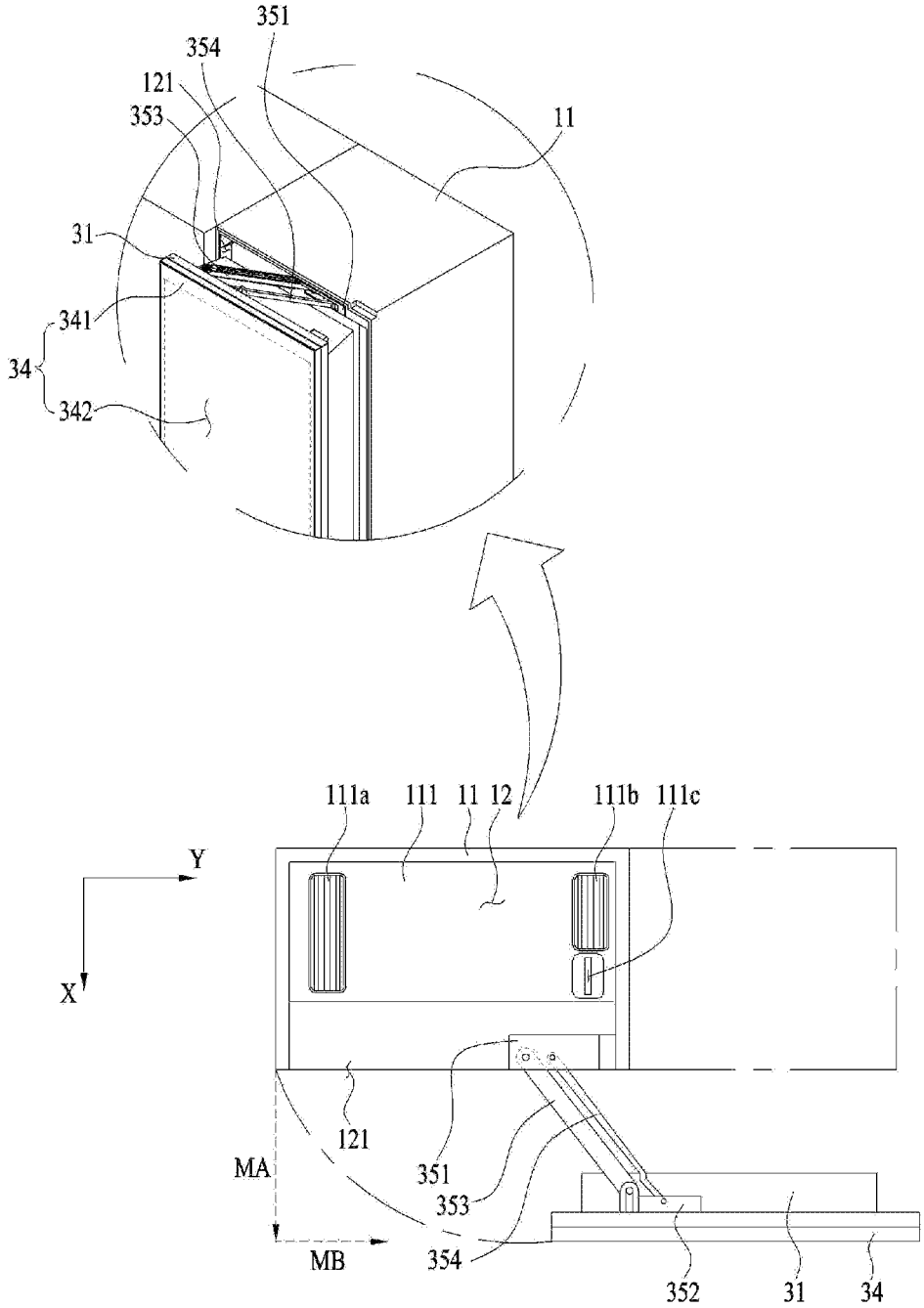
FIG. 5 shows examples of a first door and a first door hinge.

As shown in FIG. 5, when the first door 31 is opened, the first hinge 35 may enable the first door 31 to perform a combination of a first motion MA, in which the first door 31 moves in the forward direction of the cabinet 11 (i.e., the X-axis direction), and a second motion MB, in which the first door 31 moves in the width direction of the cabinet 11 (i.e., the Y-axis direction).

The reason why the first hinge 35 is configured to enable the first door 31 to perform a combination of the first motion MA and the second motion MB is to prepare for an example in which another object (e.g., a closet or another electronic apparatus) is located beside the main body 1. Performing a combination of the first motion MA and the second motion MB may mean independently and sequentially performing the first motion MA and the second motion MB, or may mean simultaneously performing the first motion MA and the second motion MB. As shown in FIG. 5, when the cabinet inlet 121 is opened or closed, the first door 31 may move along a curved track created by the combination of the first motion MA and the second motion MB. However, while the door 3 is moving, the door 3 may face the cabinet inlet 121. That is, the front surface of the door 3 is always oriented forwards while the door 3 is moving. The reason for this is to enable the user to easily access an interface, which is provided on the front surface of the second door 34, to drive the door chamber 312 even when the cabinet chamber 12 is in an open state.

If the first door 31 is configured to rotate, a space allowing rotation of an edge of the first door is necessary near the side surface of the cabinet 11. Therefore, if the first door 31 is not configured to perform the first motion MA and the second motion MB, a space needs to be secured between the side surface of the cabinet 11 and the side surface of another object, which is disadvantageous in terms of efficiency of use of indoor space or interior design.

The motion (the combination of the first motion and the second motion) of the first door 31 may be realized by the first hinge 35 having the structure shown in FIG. 5. The first hinge 35 may include a first fixed body 351 that is secured to the cabinet 11, a second fixed body 352 that is secured to the first door 31, a first connection bar 353 (or a first-hinge first connection bar) that interconnects the first fixed body and the second fixed body, and a second connection bar 354 (or a first-hinge second connection bar) that interconnects the first fixed body and the second fixed body.

The second hinge 36 may be formed to have the same structure as the first hinge 35, or may be formed to have a different structure from the first hinge 35.

FIG. 1 illustrates an example in which the second hinge 36 includes a first door fixed body 361 that is secured to the first door 31, a second door fixed body 362 that is secured to the second door 34, a first connection bar 363 (or a second-hinge first connection bar) that interconnects the two fixed bodies 361 and 362, and a second connection bar 364 (or a second-hinge second connection bar) that interconnects the two fixed bodies 361 and 362.

Figure 6:
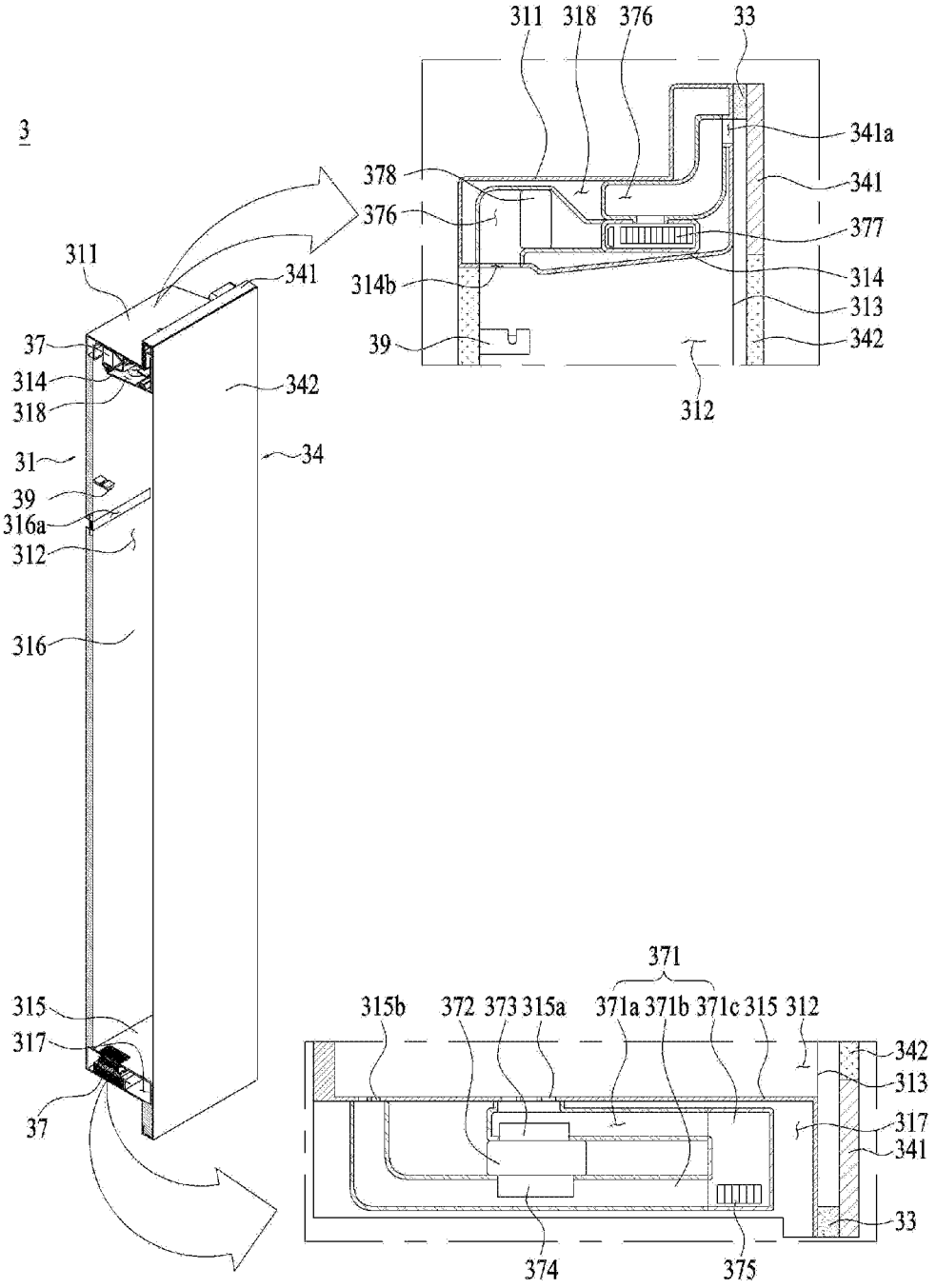
FIG. 6 shows examples of a door chamber and a second heat-exchanging unit.

As shown in FIG. 6, the first door 31 includes a first door body 311, in which the door chamber 312 is provided. The door chamber 312 may be provided as a space defined by one surface of the first door body 311 (i.e., the front surface of the first door body) being bent toward the interior of the cabinet chamber 12 (i.e., a space defined by the front surface of the first door body protruding toward the interior of the cabinet chamber).

That is, the door chamber 312 may be provided in the first door body 311 as a space for treating or exhibiting the laundry present in the cabinet chamber 12. When the cabinet inlet 121 is closed by the first door 31, the door chamber 312 is located in the cabinet chamber 12. The reason for this is to minimize not only heat loss from the cabinet chamber 12 through the door 3 but also heat loss from the door chamber 312.

The door chamber 312 may be formed in any of various shapes. FIG. 6 illustrates an example in which the door chamber 312 is formed in a hexahedral shape. In this example, the door chamber 312 may be defined by a door-chamber top surface 314, a door-chamber bottom surface 315, a door-chamber mounting surface 316, and two door-chamber side surfaces, and may have a door inlet 313 formed through one surface of the door chamber 312.

FIG. 6 illustrates an example in which the door inlet 313 is formed through the front surface of the first door body 311. In this example, the door-chamber mounting surface 316 interconnects the rear end of the door-chamber top surface 314, the rear end of the door-chamber bottom surface 315, and the rear ends of the two door-chamber side surfaces, and is disposed so as to face the door inlet 313.

The first door body 311 may have a first device chamber 317 and a second device chamber 318 formed therein.

The first device chamber 317 may be located below the door chamber 312, and the second device chamber 318 may be located above the door chamber 312. FIG. 6 illustrates an example in which the first device chamber 317 is isolated from the door chamber 312 by the door-chamber bottom surface 315, and the second device chamber 318 is isolated from the door chamber 312 by the door-chamber top surface 314.

The second door 34 may include a second door body 341 that is connected to the first door body 311 via the second hinge 36, and a transparent body 342 that is provided at the second door body 341.

The transparent body 342 is a component that enables the user to check the door chamber 312 from the outside. The second door body 341 may have a door through-hole formed therein in a shape corresponding to the edge of the door inlet 313, and the transparent body 342 may be secured to the second door body 341 to block the door through-hole, and may be embodied as transparent glass or transparent plastic.

The transparent body 342 may be made of a material that allows visible light to pass therethrough. That is, the material of the transparent body 342 may be a translucent material, rather than a transparent material, so long as the user is capable of checking laundry or an item accommodated in the door chamber 312 through the transparent body from the outside.

A support body mounting portion 39, by which the hanger 5 as well as the cabinet hanger H is supported, may be provided on the door-chamber mounting surface 316.

As shown in FIG. 1, a shelf 32 that defines a space in which laundry, a bag, and/or an accessory is supported, may be provided on the door-chamber mounting surface 316.

It is preferable for the shelf 32 to be detachably mounted on the door-chamber mounting surface 316. This may prevent laundry from interfering with the shelf 32 when the hanger 5 is hung on the support body mounting portion 39. A shelf support portion 316*a*, to which the shelf 32 is detachably secured, may be provided on the door-chamber mounting surface 316. The shelf support portion 316*a* may be formed as a slot-type recess that extends in the width direction of the door chamber 312 (i.e., the Y-axis direction).

As shown in FIG. 6, the first door body 311 may be provided with a sealing portion 33 that surrounds the door inlet 313. The sealing portion 33 serves to prevent air or moisture in the door chamber 312 from being discharged outside through the space between the first door body 311 and the second door body 341 when the door inlet 313 is blocked by the second door 34. In addition, the sealing portion 33 may also serve to maintain an interval between the front surface of the first door body 311 (i.e., the surface in which the door inlet is formed) and the second door body 341.

A second heat-exchanging unit 37 (or a second heat-exchanger) is provided in at least one of the first device chamber 317 or the second device chamber 318.

The second heat-exchanging unit 37 serves to supply air (heated air or non-heated air) to the door chamber 312. FIG. 6 illustrates an example in which the second heat-exchanging unit 37 is provided in each of the first device chamber 317 and the second device chamber 318.

The second heat-exchanging unit 37 may include a first flow path 371 that is provided in the first device chamber 317, a heat exchanger 372 (i.e., a second heat-exchanging unit) that sequentially dehumidifies and heats the air introduced into the first flow path, a first fan 375 that causes air to move through the first flow path, a second flow path 376 that is provided in the second device chamber 318, and a second fan 377 that causes air to move through the second flow path.

A lower inflow hole 315*a* and a lower outflow hole 315*b*, through which the door chamber 312 and the first device chamber 317 communicate with each other, may be formed in the door-chamber bottom surface 315.

In this example, the first flow path 371 may include an air intake duct 371*a* connected to the lower inflow hole 315*a*, an air exhaust duct 371*b* connected to the lower outflow hole 315*b*, and a connection duct 371*c* interconnecting the two ducts 371*a* and 371*b*. The first fan 375 may be located in the connection duct 371*c*.

The heat exchanger 372 may be embodied as a thermoelectric device or a thermoelectric module. The thermoelectric device or the thermoelectric module is a device or a module using the Peltier effect, which is the phenomenon whereby, when current is passed through a circuit consisting of two different metals, a temperature difference is observed at the junctions between the two different metals. When embodied as a thermoelectric device, the heat exchanger 372 is provided with a heat absorption fin 373 that is provided in the air intake duct 371*a* to cool air, and a heat radiation fin 374 that is provided in the air exhaust duct 371*b* to heat air.

An upper outflow hole 314*b*, through which the door chamber 312 and the second device chamber 318 communicate with each other, may be formed in the door-chamber top surface 314, and an upper inflow hole 314*a* that communicates with the second device chamber 318, may be formed in the front surface of the first door body 311 (i.e., the surface facing the second door body or the surface in which the door inlet is formed). Unlike what is shown in FIG. 6, the upper inflow hole 314*a* may be formed in the door-chamber top surface 314.

When the upper inflow hole 314*a* is formed in the front surface of the first door body 311, it is preferable for the sealing portion 33 to be formed in the shape of a ring that surrounds the door inlet 313 and the upper inflow hole 314*a*.

The second flow path 376 may be embodied as a duct that interconnects the upper inflow hole 314*a* and the upper outflow hole 314*b*. The second fan 377 may be provided in the second flow path 376, and a heating unit 378 (i.e., a third heat-exchanging unit) that heats the air that has passed through the second fan 377, may be further provided in the second flow path 376.

When the first fan 375 operates, the air in the door chamber 312 is introduced into the air intake duct 371*a* through the lower inflow hole 315*a*. The air introduced into the air intake duct is condensed while flowing through the heat absorption fin 373, and the dehumidified air is heated while flowing through the heat radiation fin 374. The heated air is re-supplied to the door chamber 312 through the air exhaust duct 371*b* and the lower outflow hole 315*b*. Accordingly, the laundry treating apparatus 100 may dry laundry or an accessory accommodated in the door chamber 312, and may maintain constant humidity.

The second fan 377 and the heating unit 378 may operate during operation of the first fan 375 and the heat exchanger 372. Accordingly, when the number of laundry articles or accessories accommodated in the door chamber 312 is large, it is possible to dry the same and/or to control humidity in a short time.

When the second fan 377 operates, the air in the door chamber 312 may move along the second flow path 376, and the air moving along the second flow path may be heated while flowing through the heating unit 378.

The upper outflow hole 314*b* may be located above the support body mounting portion 39 so that the air discharged from the second flow path 376 is directly supplied to the laundry hung on the hanger 5.

Figure 7:
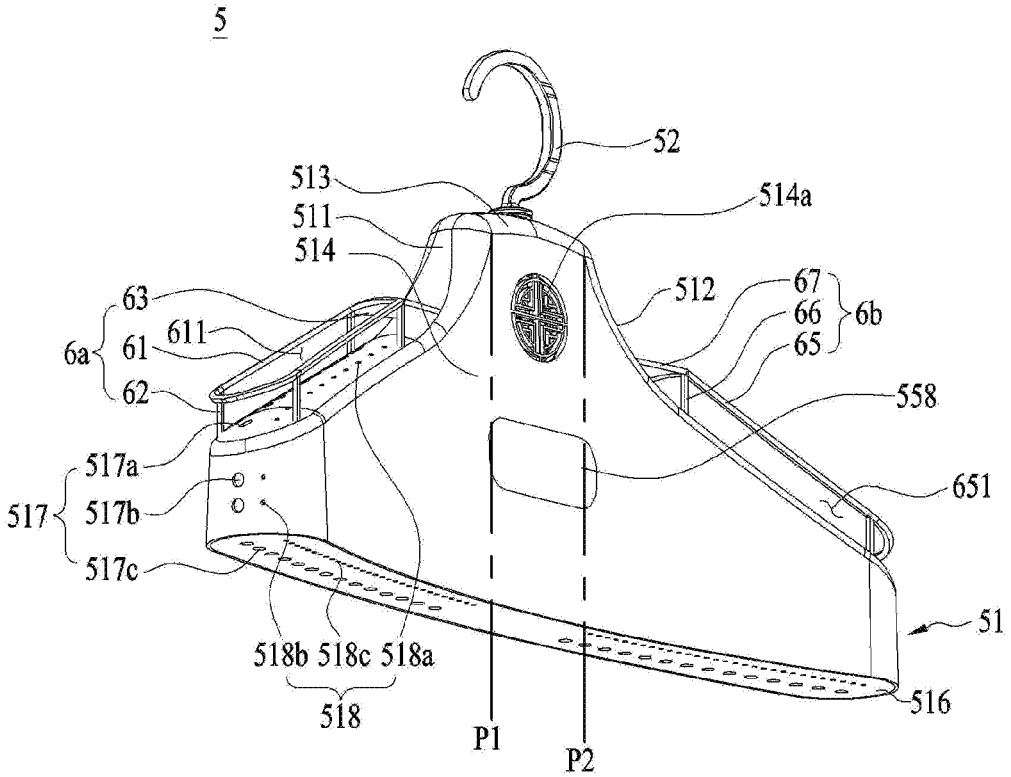
FIG. 7 shows an example of the hanger.

FIG. 7 shows an example of the hanger 5 that is mountable in the door chamber 312 or the cabinet chamber 12. As shown in FIG. 7, the hanger 5 may include a hook-shaped fastening unit 52 (or hook-shaped fastener).

Therefore, the hanger 5 may be hung on a hanging bar irrespective of the laundry treating apparatus 100. The hanger 5 may be removably mounted in the laundry treating apparatus 100. The hanger 5 may be hung on the hanger support unit 17, more specifically in the hook receiving recess 175, or may be hung on the support body mounting portion 39 (refer to FIG. 14) provided in the door chamber 312.

Compared to the above-described cabinet hanger H, the hanger 5 is characterized by including at least one of an air supply unit 53 (see FIG. 8 for example) for supplying air to laundry or a moisture supply unit 55 (see FIG. 8 for example) for supplying moisture to laundry. Therefore, the hanger 5 may independently manage laundry hung on the hanger 5 separately from the laundry treating apparatus 100. The air supply unit 53 is a structural device, and may be referred to as an air supply device. The moisture supply unit 55 is a structural device, and may be referred to as a moisture supply device.

The hanger 5 may not only be used in the cabinet chamber 12 or the door chamber 312 of the laundry treating apparatus 100, but may also be independently used in any of places in which a general hanger can be placed, for example in a closet or in a place in which a hanging bar or a hanging hook is provided, irrespective of the laundry treating apparatus 100.

When the hanger 5 is used in the cabinet chamber 12, the hanger 5 may be hung on the hanger support unit 17. Alternatively, the hanger 5 may be hung on any one of the left side surface, the right side surface, and the rear surface of the cabinet chamber 12.

It may also be possible to manage laundry using the hanger 5 in a limited space not allowing mounting of the first machine compartment 13 accommodating devices for supplying hot air and moisture. That is, when it is difficult to mount a device for spraying hot air and/or steam (or moisture) due to a limitation in the space in which laundry is accommodated, only the hanger 5 may be independently used to manage laundry hung thereon by supplying hot air and/or steam (or moisture) to the laundry.

Referring to FIG. 7, the hanger 5 may include a support body 51 for supporting laundry and a fastening unit 52 for securing the support body 51 to the support body mounting portion 39 provided in the door chamber 312. The fastening unit 52 is structural and may be referred to as a fastener and/or a fastening device.

Additionally, the hanger 5 may include spacers 6*a* and 6*b*, which are formed at the upper portion of the support body 51 and are spaced apart from each other, with the fastening unit 52 interposed therebetween, in order to support the laundry such that the laundry is spaced apart from the support body 51.

The support body 51 may further include an air intake hole 514*a* for suctioning external air into the support body 51 and an air exhaust hole 517 for discharging the suctioned air. The support body 51 may include a supply tank 558 for supplying moisture.

The air intake hole 514*a* may be located above the supply tank 558 so as to overlap the supply tank 558 in the height direction of the hanger 5. This structure may be made in consideration of the weight balance of the hanger 5. For the same reason, the fastening unit 52 may be located so as to overlap the air intake hole 514*a* in the height direction of the hanger 5.

The air intake hole 514*a* may be located at an upper portion of the support body 51. This may prevent the laundry hung on the support body 51 from blocking the air intake hole 514*a* and thus disturbing suction of external air through the air intake hole 514*a*.

The air exhaust hole 517 may be provided in plural, and the plurality of air exhaust holes 517 may be formed in each of the top surface, the left and right side surfaces, and a body bottom surface 516 of the support body 51 that forms the bottom surface of the support body 51. This may discharge air suctioned through the air intake hole 514*a* to various parts of the laundry hung on the hanger 5. This may maximally uniformly distribute air over the laundry.

A plurality of discharge holes 518 may be formed in each of the top surface, the left and right side surfaces, and the body bottom surface 516 of the support body in order to supply moisture or steam from the supply tank 558 to the laundry. The air exhaust holes 517 and the discharge holes 518 may be disposed to be parallel to each other. When the direction in which the air intake hole 514*a* is open is defined as a forward direction, the air exhaust holes 517 may be located behind the discharge holes 518.

The size of each of the air exhaust holes 517 may be larger than the size of each of the discharge holes 518. Considering the sizes of the particles of moisture and air, it may be preferable that the size of each of the discharge holes 518 be smaller than the size of each of the air exhaust holes 517 in order to spray moisture.

When the hanger 5 is coupled to the support body mounting portion 39 located on the door-chamber mounting surface 316, if the discharge holes 518 are located close to the door-chamber mounting surface 316, a relatively large amount of condensed water may be generated. Due to the above-described disposition of the discharge holes 518 and the air exhaust holes 517, generation of condensed water may be maximally prevented. That is, it is preferable for the discharge holes 518 to be located farther away from the door-chamber mounting surface 316 than the air exhaust holes 517.

The support body 51 is formed such that the left and right portions thereof are curved forwards from the central portion thereof. That is, the support body 51 is formed in the shape of a bow (i.e., the two opposite side portions are bent forwards). The reason why the support body 51 is formed in the shape of a curved surface that is convex backwards is not only to match the shape or the design of the laundry hung on the hanger 5, but also to allow the discharge holes to be located as far away from the door-chamber mounting surface 316 as possible.

Figure 8:
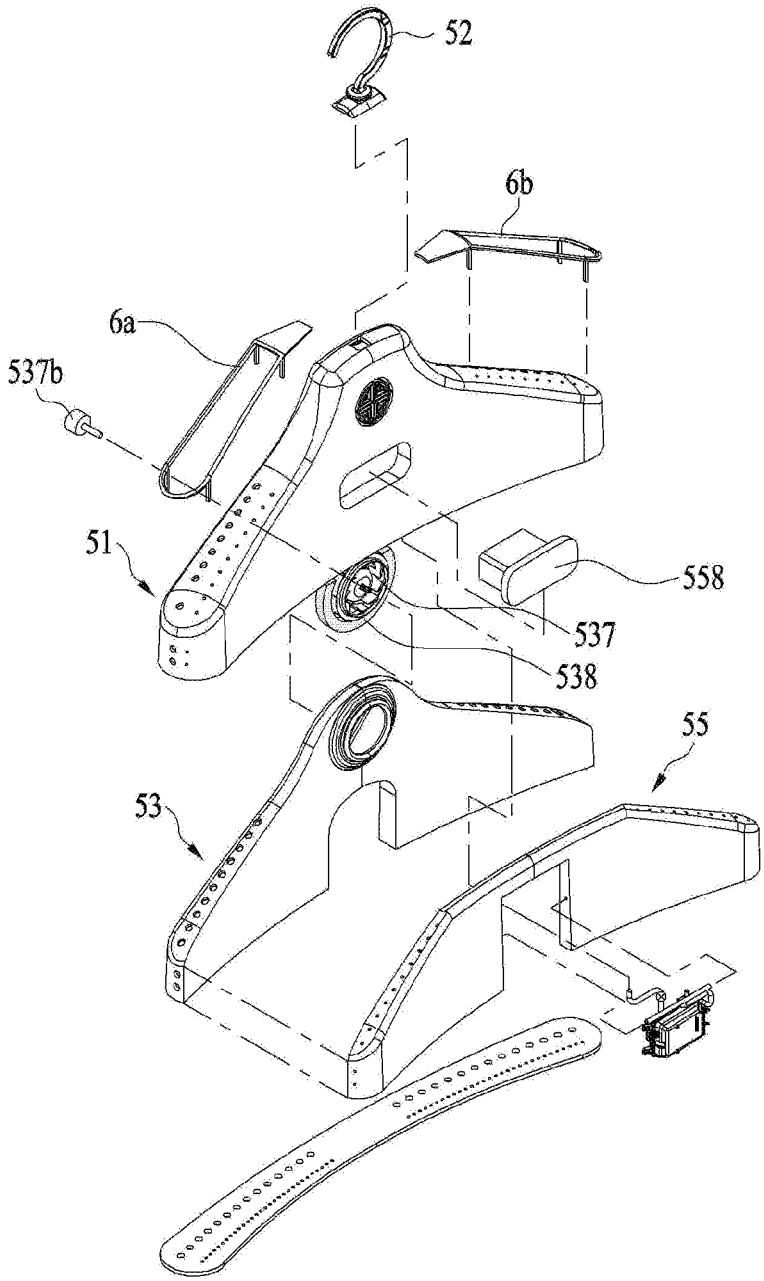
FIG. 8 shows an example of the hanger in an exploded manner.

FIG. 8 is an exploded perspective view of an example of the hanger 5.

The hanger 5 may include a support body 51 for supporting laundry and a fastening unit 52 coupled to the upper side of the support body 51 to allow the support body to be hung on the support body mounting portion 39. The fastening unit 52 may include a hanger hook.

The hanger 5 may include spacers 6*a* and 6*b* that are formed at the upper portion of the support body 51 and are spaced apart from each other, with the fastening unit 52 interposed therebetween.

Additionally, the hanger 5 may include an air supply unit 53 that is provided in (or at) the support body 51 to supply air to laundry supported by the support body 51, and a moisture supply unit 55 that is provided in (or at) the support body 51 to supply moisture or steam to the laundry. The air supply unit 53 is a structural device and may also be referred to as an air supply device.

The hanger 5 may include a supply tank 558 that is mounted on one surface of the support body 51 to supply water that is to be used for supply of moisture or steam to the laundry.

Referring to FIG. 8, the support body 51 may be bilaterally symmetrical with respect to the fastening unit 52. The spacers 6*a* and 6*b* may be formed to be symmetrical with each other. The reason for this is that clothes are generally formed to be bilaterally symmetrical.

Figure 9:
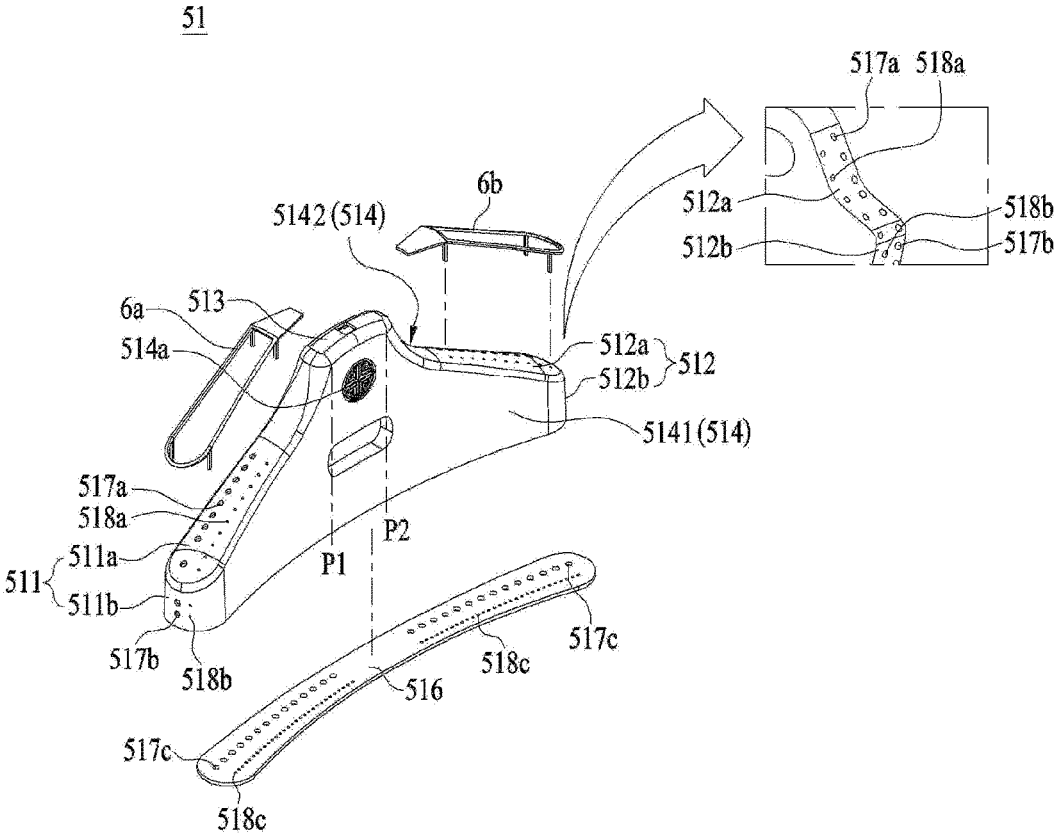
FIG. 9 shows an example of a support body of the hanger in an exploded manner.

FIG. 9 is an exploded perspective view showing the support body 51 and the spacers 6*a* and 6*b* among the components of the hanger 5 shown in FIG. 8.

The support body 51 may include a base 513, to which the fastening unit 52 is secured, a first support surface 511 that extends from one side of the base 513 to support laundry and has a space defined therein, a second support surface 512 that extends from the other side of the base 513 to support laundry and has a space defined therein, and a connection surface 514 that connects the base 513 to the support surfaces 511 and 512.

The first support surface 511 and the second support surface 512 may be located at positions symmetrical with each other with respect to the base 513. The reason for this is that clothes have a substantially bilaterally symmetrical shape.

The first support surface 511 may be formed as a downwardly slanted surface that extends from a first boundary P1 that is located at the left end of the base 513, and the second support surface 512 may be formed as a downwardly slanted surface that extends from a second boundary P2 that is located at the right end of the base 513. The connection surface 514 may include a first connection surface 5141 that faces the front surface of the laundry, and a second connection surface 5142 that faces the rear surface of the laundry.

The reason why the first support surface 511 and the second support surface 512 are formed as slanted surfaces is to allow laundry to be hung thereon regardless of size. That is, various sizes of laundry articles, e.g. children's clothes or adults' clothes, may be hung on the hanger 5. If the support body has a rectangular shape, and the first support surface and the second support surface are formed as horizontal surfaces having sizes suitable for adults' clothes, rather than slanted surfaces, it is difficult to hang children's clothes, which are smaller than adults' clothes, on the hanger 5. On the other hand, if the first support surface and the second support surface are formed as horizontal surfaces having sizes suitable for children's clothes, it is not possible to hang adults' clothes on the hanger 5. Therefore, the first support surface 511 and the second support surface 512 are formed as slanted surfaces so that various sizes of laundry articles are stably supported by the hanger 5 in a symmetrical shape. That is, depending on the type or size of laundry hung on the hanger 5, the parts of the laundry that are hung on the first support surface 511 and the second support surface 512 may vary.

The support body 51 may be provided with the body bottom surface 516. The body bottom surface 516 may be a bottom surface that interconnects the free end of the first support surface 511, the free end of the second support surface 512, and the free ends of the two connection surfaces 5141 and 5142.

As shown in FIG. 9, the connection surface 514 may have an air intake hole 514*a* formed therein to suction air into the support body 51. The air intake hole 514*a* may be formed in any one of the first connection surface 5141 that faces the front surface of the laundry, and the second connection surface 5142 that faces the rear surface of the laundry. In an example in which the hanger 5 is used alone, the air intake hole 514*a* may be formed in any one of the first connection surface 5141 and the second connection surface 5142. However, considering that the hanger 5 is hung on the door-chamber mounting surface 316, it may be preferable for the air intake hole 514*a* to be formed in the first connection surface 5141.

It is preferable for the air intake hole 514*a* to be located at a position that is not covered by the laundry. The air intake hole 514*a* is formed in the upper portion of the support body 51 in order to facilitate suction of external air. Therefore, it may be preferable for the air intake hole 514*a* to be located closer to the fastening unit 52 than to the body bottom surface 516.

As shown in FIG. 9, each of the first support surface 511 and the second support surface 512 may have formed therein air exhaust holes 517, through which air is discharged, and discharge holes 518, through which moisture is discharged.

As shown in FIG. 9, the first support surface 511 may include a first top surface 511*a* that is secured to the base 513 to support the upper part or one of the left part and the right part of the laundry, and a first side surface 511*b* that extends from the first top surface 511*a* so as to be located at a position corresponding to one of the sleeves of the laundry. The second support surface 512 may include a second top surface 512*a* that is secured to the base 513 to support the upper part or the other of the left part and the right part of the laundry, and a second side surface 512*b* that extends from the second top surface 512*a* so as to be located at a position corresponding to the other of the sleeves of the laundry.

The reason why the first top surface 511*a* and the second top surface 512*a* are formed so as to be slanted is to allow laundry to be hung thereon regardless of size. The first side surface 511*b* and the second side surface 512*b* may respectively extend from the first top surface 511*a* and the second top surface 512*a* at different angles from the first top surface 511*a* and the second top surface 512*a*.

As shown in FIG. 9, the first side surface 511*b* and the second side surface 512*b* may extend vertically, or may be slanted more steeply than the first top surface 511*a* and the second top surface 512*a*, respectively. The reason for this is to remove wrinkles from the laundry hung on the hanger 5 by applying as much tension as possible to the part of the laundry other than the parts thereof supported by the first top surface 511*a* and the second top surface 512*a*, using the weight of the laundry.

Additionally, in order to supply air and/or moisture (steam) to as large an area as possible of the part of the laundry hung on the hanger 5, which is not supported by the first top surface 511*a* or the second top surface 512*a*, it may be preferable for the first side surface 511*b* and the second side surface 512*b* to extend vertically or to be slanted in different directions from the first top surface 511*a* and the second top surface 512*a*, respectively.

The air exhaust hole 517 may include at least one of a first air exhaust hole 517*a* formed in each of the first top surface 511*a* and the second top surface 512*a*, a second air exhaust hole 517*b* formed in each of the first side surface 511*b* and the second side surface 512*b*, and/or a third air exhaust hole 517*c* formed through the body bottom surface 516.

The discharge hole 518 may include at least one of a first discharge hole 518*a* formed in each of the first top surface 511*a* and the second top surface 512*a*, a second discharge hole 518*b* formed in each of the first side surface 511*b* and the second side surface 512*b*, and/or a third discharge hole 518*c* formed through the body bottom surface 516. FIG. 9 illustrates an example in which the air exhaust hole 517 includes all of the first air exhaust hole 517*a*, the second air exhaust hole 517*b*, and the third air exhaust hole 517*c*, and the discharge hole 518 includes all of the first discharge hole 518*a*, the second discharge hole 518*b*, and the third discharge hole 518*c*.

Meanwhile, each of the first connection surface 5141 and the second connection surface 5142 may be formed such that the left and right portions thereof are curved gently in the forward direction of the hanger 5. The reason for this is to increase the rigidity of the support body 51. Additionally, the reason for this is to allow the discharge holes 518 to be located far away from the door-chamber mounting surface 316.

Meanwhile, referring to FIGS. 7 to 9, in order to minimize increase in resistance to flow of air or moisture due to blocking of the air exhaust holes 517 and the discharge holes 518 by the laundry hung on the support body 51, the hanger 5 may include spacers 6*a* and 6*b* to allow the laundry to be spaced a predetermined interval apart from the support body 51.

The spacers 6*a* and 6*b* may include a first spacer 6*a* that is secured to the support body 51 to maintain a predetermined interval between the laundry and the first support surface 511, and a second spacer 6*b* that is secured to the support body 51 to maintain a predetermined interval between the laundry and the second support surface 512.

The first spacer 6*a* may include a first seating body 61, by which the laundry is supported, and a first fixed portion 62 that secures the first seating body 61 to the first support surface 511. The second spacer 6*b* may include a second seating body 65, by which the laundry is supported, and a second fixed portion 66 that secures the second seating body 65 to the second support surface 512.

The first fixed portion 62 may be formed in the shape of a bar that secures the first seating body 61 to the first top surface 511*a*, and the second fixed portion 66 may be formed in the shape of a bar that secures the second seating body 65 to the second top surface 512*a*.

The first seating body 61 may have a first-seating-body through-hole 611 formed therein to allow fluid supplied from the first air exhaust holes 517*a* and the first discharge holes 518*a* formed in the first top surface 511*a* to pass therethrough. Similarly, the second seating body 65 may have a second-seating-body through-hole 651 formed therein to allow fluid supplied from the first air exhaust holes 517*a* and the first discharge holes 518*a* formed in the second top surface 512*a* to pass therethrough.

The first spacer 6*a* may include a first upper support portion 63 that connects the upper end of the first seating body 61 to the first support surface 511 to support a portion of the upper part of the laundry, and the second spacer 6*b* may include a second upper support portion 67 that connects the upper end of the second seating body 65 to the second support surface 512 to support another portion of the upper part of the laundry.

As described above, the air intake hole 514*a* is disposed at a position that is not covered by the laundry. The first upper support portion 63 and the second upper support portion 67 may be provided such that the air intake hole 514*a* is located between the first upper support portion 63 and the second upper support portion 67.

Figure 10:
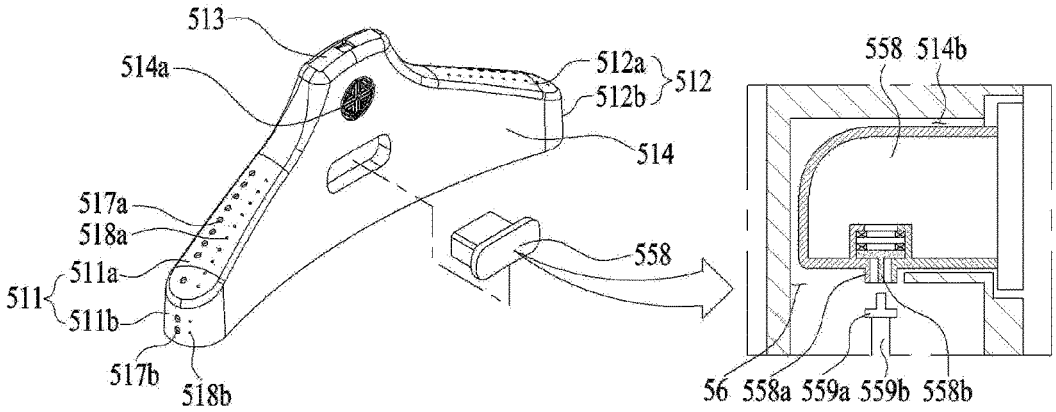
FIG. 10 shows examples of a water supply tank and a tank mounting portion.

FIG. 10 shows a supply tank 558 and a tank mounting portion 514*b* provided in the support body 51 to receive the supply tank 558.

The supply tank 558 is secured to the support body 51 through the tank mounting portion 514*b* provided in (or at) the connection surface 514. A drain hole 558*a* is formed in a bottom surface of the supply tank 558. The opening of the drain hole 558*a* is controlled by the valve 558*b*. The valve 558*b* may be embodied as a check valve.

A supply flow path 559 may be provide that includes an actuator 559*a* for operating the valve 558*b* to open the drain hole 558*a*, a connection pipe 559*b* for connecting the actuator 559*a* to a moisture generator 556, and a connection-pipe valve 559*c* for controlling opening and closing of the connection pipe 559*b*.

As shown in FIG. 10, when the supply tank 558 is inserted into the tank mounting portion 514*b*, the actuator 559*a* operates the valve 558*b* to open the drain hole 558*a*. When the drain hole 558*a* is opened, the water in the supply tank 558 may flow into the connection pipe 559*b*. When the connection-pipe valve 559*c* opens the connection pipe 559*b*, the water may flow to the moisture generator 556.

Figure 11:
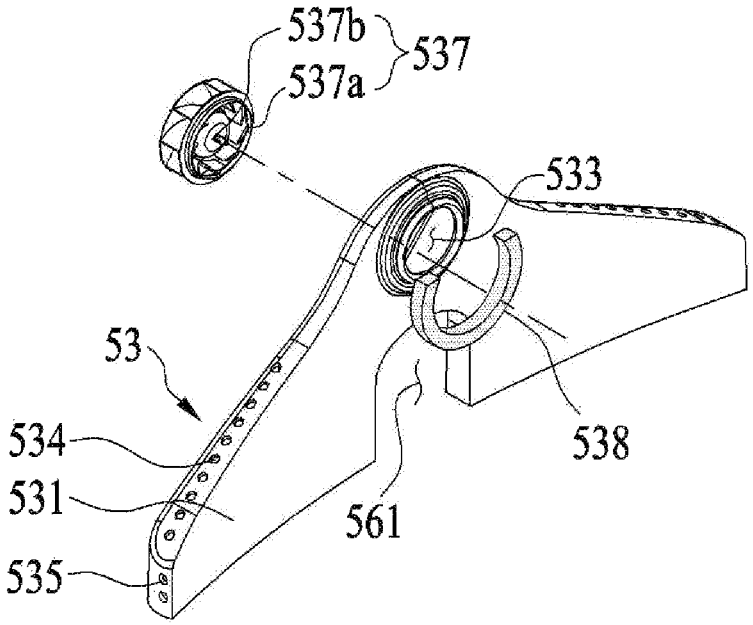
FIG. 11 shows an air supply unit in the support body.
Figure 13:
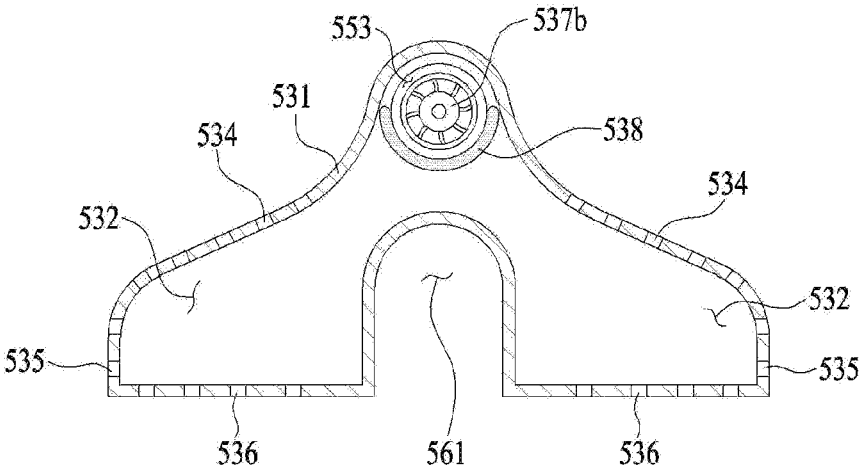
FIG. 13(*a*) shows an example of the air supply unit, and FIG. 13(*b*) shows an example of the moisture supply unit.
Figure 13:
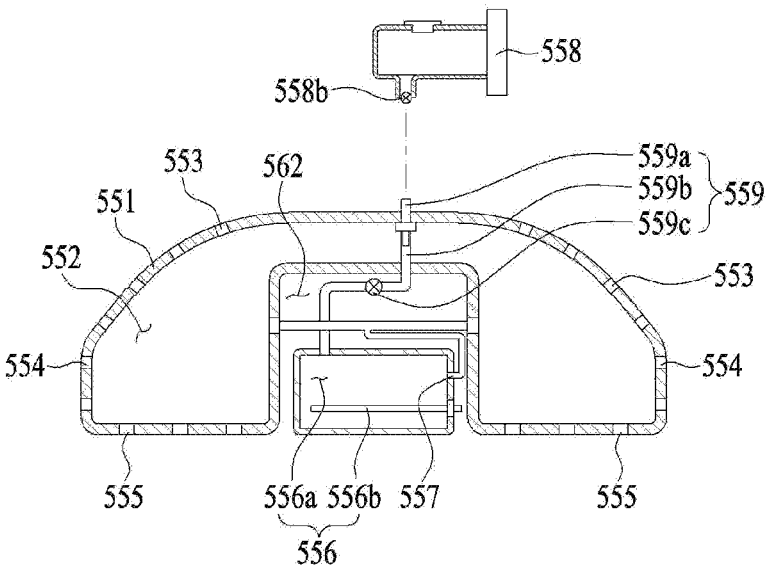

Referring to FIG. 11, the air supply unit 53 may include an air supply body 531 that has an air flow path 532 (see FIG. 13(*a*) for example) formed therein. The air supply body 531 may be formed in any of various shapes, so long as the same is capable of being inserted into the support body 51. The air supply body 531 may be inserted into or taken out of the support body 51 in the state in which the body bottom surface 516 is separated from the support body 51.

The air flow path 532 is a flow path that connects the air intake hole 514*a* to the air exhaust holes 517. The air flow path 532 is connected to the air intake hole 514*a* via an air-intake-hole connection portion 533, and is connected to the air exhaust holes 517 via air-exhaust-hole connection portions. That is, the air-exhaust-hole connection portions may be formed through the air supply body 531, and may include a first air-exhaust-hole communication hole 534 that connects the air flow path 532 to the first air exhaust hole 517*a*, a second air-exhaust-hole communication hole 535 that connects the air flow path 532 to the second air exhaust hole 517*b*, and a third air-exhaust-hole communication hole 536 (see FIG. 13(*a*) for example) that connects the air flow path 532 to the third air exhaust hole 517*c*.

The air supply body 531 may be provided therein with a fan 537 and a heater 538 (i.e., a first heater).

As shown in FIG. 11, the fan 537 serves to suction external air into the air flow path 532 through the air intake hole 514*a* and the air-intake-hole connection portion 533. The fan 537 may include an impeller 537*a* that is located in the air-intake-hole connection portion 533, and an impeller motor 537*b* that is secured to the air supply body or the support body to rotate the impeller. The impeller 537*a* may be disposed such that the center of rotation thereof is located at the center of the rotary shaft of the impeller motor 537*b* (i.e., the center of the air-intake-hole connection portion 533 or the center of the air intake hole 514*a*).

The heater 538 serves to heat air that has passed through the impeller 537*a*. The heater 538 may be embodied as a C-shaped heating element (i.e., an electric resistor configured to convert electrical energy into thermal energy). The heater 538 may be formed in the shape of partly surrounding the circumferential surface of the impeller 537*a* (or the shape of partly surrounding the edge of the air-intake-hole connection portion), and the open portion of the C-shaped heater 538 may face the fastening unit 52 (or the uppermost end of the air supply body).

This may prevent the fastening unit 52 from being heated by the air heated by the heater 538. When the fan 537 rotates, air may be suctioned through the air intake hole 514*a* in the rotation direction of the fan 537 (i.e. the forward-backward direction of the hanger 5), may be discharged through the side surface of the fan 537, and may move to the air flow path 532. This fan may be referred to as a sirocco fan. The air suctioned along the rotary shaft of the fan 537 or the rotary shaft of the motor 537*b* is discharged outside through the side surface of the fan, which is perpendicular to the rotary shaft thereof.

Therefore, the air intake hole 514*a* may be formed in one surface of the support body 51, and the air exhaust holes 517 may be formed in another one or more of the surfaces of the support body 51.

That is, the air intake hole 514*a* may be formed in the first connection surface 5141, and the air exhaust holes 517 may be formed in the first top surface 511*a*, the second top surface 512*a*, the first side surface 511*b*, the second side surface 512*b*, and the body bottom surface 516.

This is merely given by way of example, and any of various other fans may be used, so long as the same is capable of suctioning air through the air intake hole 514*a* and moving the air to the air flow path 532.

The heater 538 may be located closer to the air intake hole 514*a* than to the air exhaust holes 517. More specifically, the heater 538 may be adjacent to the fan 537 and may surround a portion of the fan 537. The reason for this is not only to effectively heat air discharged from the fan 537 before the air is dispersed, but also to prevent overheating of the heater 538. That is, the air discharged from the fan 537 receives heat from the heater 538, thereby preventing the heater 538 from overheating and being damaged.

Figure 12:
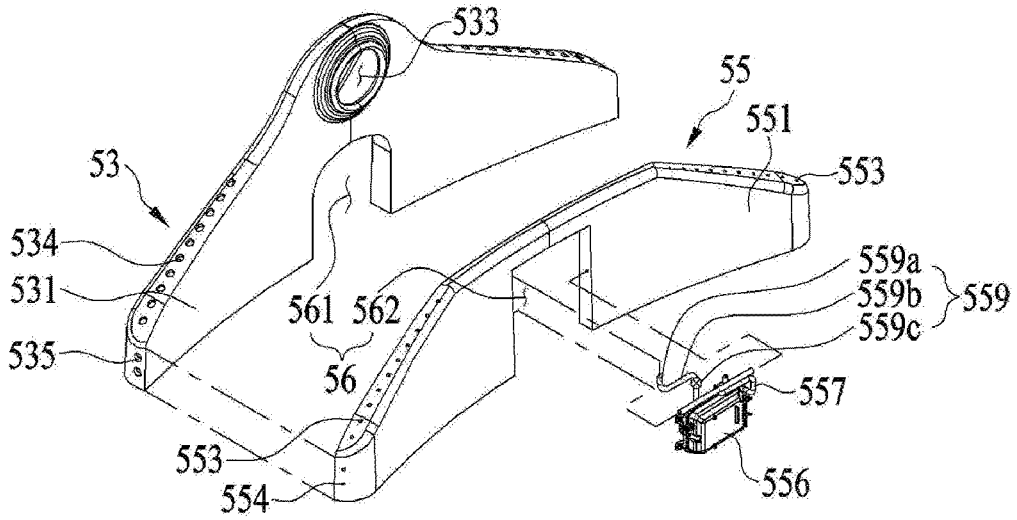
FIG. 12 shows a portion of the air supply unit and a portion of a moisture supply unit provided in the support body.

Referring to FIG. 12, the hanger 5 may include an air supply unit 53 that is provided in the support body 51 to supply air to laundry supported by the support body 51, and a moisture supply unit 55 that is provided in the support body 51 to supply moisture or steam to the laundry.

The moisture supply unit 55 may include a moisture generator 556 that generates moisture or steam, a moisture supply body 551 that forms a moisture flow path 552 (see FIG. 13(*b*) for example) to discharge moisture or steam generated in the moisture generator 556 to the outside, a supply tank 558 (see FIG. 8 for example) that supplies water to the moisture generator 556, and a supply flow path 559 that supplies water from the supply tank 558 to the moisture generator. The remaining components of the moisture supply unit other than the supply tank 558 are illustrated in FIG. 12.

The air supply unit 53 may be located behind the moisture supply unit 55. This may reduce moving paths of air and moisture (or steam) in consideration of the positions of the air exhaust holes 517 and the discharge holes 518. The longer the moving paths, the greater the heat loss of air and moisture. More specifically, the moisture supply body 551 may be located in front of the air supply body 531.

The height of the uppermost end of the moisture supply body 551 may be less than the height of the uppermost end of the air supply body 531. This may enable connection between the air-intake-hole connection portion 533 that is located at the upper portion of the air supply body 531, and the air intake hole 514*a*.

Because the moisture generator 556, the supply tank 558, and the supply flow path 559 are located in the support body 51 (or at the support body 51), at least one of the air supply body 531 or the moisture supply body 551 may include an accommodating portion 56 that defines a space for accommodating the moisture generator 556, the supply tank 558, and the supply flow path 559.

FIG. 12 illustrates an example in which the accommodating portion 56 includes a generator accommodating portion 562 that is provided in the moisture supply body 551 to define a space for accommodating the moisture generator 556, and a tank accommodating portion 561 that is provided in the air supply body 531 to define a space for accommodating the supply tank 558.

Referring to FIGS. 10 and 12, the generator accommodating portion 562 may be formed as a recess that is depressed in the bottom surface of the moisture supply body 551 toward the top surface of the moisture supply body 551, and the tank accommodating portion 561 may be formed as a recess that is depressed in the bottom surface of the air supply body 531 toward the top surface of the air supply body 531.

When the tank mounting portion 514*b* is located higher than the moisture generator 556 (water in the supply tank is supplied to the moisture generator without a pump), the height of the tank accommodating portion 561 needs to be set to be greater than the height of the generator accommodating portion 562.

The tank mounting portion 514*b* provided in the connection surface 514 forms a passage that penetrates the connection surface 514 to be connected to the tank accommodating portion 561, and the valve 558*b* of the supply tank 558 is coupled to the actuator 559*a* when the supply tank 558 is inserted into the accommodating portion 56 through the tank mounting portion 514*b*.

FIGS. 10 and 12 illustrate an example in which the supply tank 558 is inserted into the tank accommodating portion 561 through the tank mounting portion 514*b*.

When the generator accommodating portion 562 is provided, a moisture supply pipe 557 may be provided so as to supply moisture through two opposite side surfaces of the generator accommodating portion 562 (i.e., the left surface and the right surface of the generator accommodating portion that extend in the height direction of the support body). Accordingly, the amount of moisture supplied to the discharge holes 518 formed in the first support surface 511 and the amount of moisture supplied to the discharge holes 518 formed in the second support surface 512 may be similar to each other.

An air supply unit 53 that moves air (heated air or non-heated air) introduced into the air intake hole 514*a* to the air exhaust holes 517, and a moisture supply unit 55 that generates moisture (heated steam or non-heated steam) and supplies the same to the discharge holes 518. The air supply unit may be provided in (or at) the support body 51.

Referring to FIGS. 8 to 12, the fan 537 may be located closer to the air intake hole 514*a* than to the air exhaust holes 517. The reason for this is to more easily suction external air. Due to the characteristics of the support body 51, in which the width thereof in the forward-backward direction is less than that in the width direction, and the sizes of the air exhaust holes 517, the flow speed at which the air suctioned into the hanger, (i.e., the support body 51), is discharged naturally increases. Therefore, force required to suction external air may be greater than force required to discharge internal air.

The discharge holes 518 may be located closer to the air exhaust holes 517 than to the air intake hole 514*a*. The reason for this is to prevent moisture discharged from the discharge holes 518 from being suctioned into the air intake hole 514*a*.

The fan 537 may be located closer to the air intake hole 514*a* than to the air exhaust holes 517. In addition, the fan 537 may be located closer to the air intake hole 514*a* than to the discharge holes 518.

The air intake hole 517 may be located between the first support surface 511 and the second support surface 512 in order to maintain lateral balance of the support body 51. For the same reason, the fan 537 may also be located between the first support surface 511 and the second support surface 512.

As shown in FIG. 13(*a*), the air supply unit 53 may include an air supply body 531 that has an air flow path 532 formed therein. The air supply body 531 may be formed in any of various shapes, so long as the same is capable of being inserted into the support body 51. The air supply body 531 may be inserted into or taken out of the support body 51 in the state in which the body bottom surface 516 of the support body is separated from the support body 51.

The air flow path 532 is a flow path that connects the air intake hole 514*a* to the air exhaust holes 517. The air flow path 532 is connected to the air intake hole 514*a* via an air-intake-hole connection portion 533, and is connected to the air exhaust holes 517 via air-exhaust-hole connection portions. The air-exhaust-hole connection portions may be formed through the air supply body 531, and may include first air-exhaust-hole communication holes 534 connecting the air flow path 532 to the first air exhaust holes 517*a*, second air-exhaust-hole communication holes 535 connecting the air flow path 532 to the second air exhaust holes 517*b*, and third air-exhaust-hole communication holes 536 connecting the air flow path 532 to the third air exhaust holes 517*c*.

A fan 537 and a heater 538 (i.e., a first heater) may be provided in the air supply body 531.

As shown in FIG. 8, the fan 537 serves to suction external air into the air flow path 532 through the air intake hole 514*a* and the air-intake-hole connection portion 533. The fan 537 may include an impeller 537*a* that is located in the air-intake-hole connection portion 533, and an impeller motor 537*b* that is secured to the air supply body or the support body to rotate the impeller. The impeller 537*a* may be disposed such that the center of rotation thereof is located at the center of the air-intake-hole connection portion 533.

The heater 538 serves to heat air that has passed through the impeller 537*a*. The heater 538 may be embodied as a C-shaped heating element (i.e., an electric resistor configured to convert electrical energy into thermal energy). The heater 538 may be formed in the shape of surrounding (or partly surrounding) the circumferential surface of the impeller 537*a* (or the shape of surrounding the edge of the air-intake-hole connection portion), and the open portion of the C-shaped heater 538 may face the fastening unit 52 (or the uppermost end of the air supply body).

The moisture supply unit 55 may include a moisture supply body 551 that has a moisture flow path 552 formed therein. The moisture supply body 551 may be formed in any of various shapes, so long as the same is capable of being inserted into the support body 51. The moisture supply body 551 may be inserted into or taken out of the support body 51 in the state in which the body bottom surface 516 of the support body is separated from the support body 51.

As shown in FIG. 13(*b*), the moisture flow path 552 is a flow path that supplies moisture generated in the moisture generator 556 to the discharge holes 518. The moisture flow path 552 is provided with discharge-hole connection portions that are connected to the discharge holes 518.

The discharge-hole connection portions may be formed through the moisture supply body 551, and may include first discharge-hole communication holes 553 connecting the moisture flow path 552 to the first discharge holes 518*a*, second discharge-hole communication holes 554 connecting the moisture flow path 552 to the second discharge holes 518*b*, and third discharge-hole communication holes 555 connecting the moisture flow path 552 to the third discharge holes 518*c*.

The moisture generator 556 may be embodied as a steam generator configured to generate (or provide) heated steam, or may be embodied as a mist generator configured to generate (or provide) non-heated steam (mist or the like). FIG. 13(*b*) illustrates an example in which the moisture generator 556 is embodied as a steam generator.

The moisture generator 556 shown in FIG. 13(*b*) may include a storage body 556*a* that has a space defined therein to store water and is located in the support body 51, and a heater 556*b* (i.e., a second heater), that heats water in the storage body.

The moisture generator 556 may be connected to the moisture flow path 552 via a moisture supply pipe 557, and a valve for controlling movement of moisture to the moisture flow path 552 may be provided in the moisture supply pipe 557.

Referring to FIGS. 8 and 13, the moisture generator 556 receives water stored in the supply tank 558 through the supply flow path 559.

The supply tank 558 may have a space defined therein to store water, and may be detachably secured to the support body 51. The supply flow path 559 may guide the water stored in the supply tank 558 to the storage body 556*a*.

The supply tank 558 is secured to the support body 51 through the tank mounting portion 514*b* provided in the connection surface 514. A drain hole 558*a* is formed in the bottom surface of the supply tank 558. The opening of the drain hole 558*a* is controlled by the valve 558*b*. The valve 558*b* may be embodied as a check valve.

The supply flow path 559 may include an actuator 559*a* for operating the valve 558*b* to open the drain hole 558*a*, a connection pipe 559*b* connecting the actuator 559*a* to the storage body 556*a* of the moisture generator, and a connection-pipe valve 559*c* controlling opening and closing of the connection pipe 559*b*.

As shown in the drawings, when the supply tank 558 is inserted into the tank mounting portion 514*b*, the actuator 559*a* operates the valve 558*b* to open the drain hole 558*a*. When the drain hole 558*a* is opened, the water in the supply tank 558 may flow into the connection pipe 559*b*. When the connection-pipe valve 559*c* opens the connection pipe 559*b*, the water may flow to the storage body 556*a*.

Because the moisture generator 556, the supply tank 558, and the supply flow path 559 are located in the support body 51 (or at the support body), at least one of the air supply body 531 or the moisture supply body 551 may include an accommodating portion 56 that defines a space for accommodating the moisture generator 556, the supply tank 558, and the supply flow path 559.

FIG. 13(*b*) illustrates an example in which the accommodating portion 56 includes a generator accommodating portion 562 that is provided in the moisture supply body 551 to define a space for accommodating the moisture generator 556, and a tank accommodating portion 561 that is provided in the air supply body 531 to define a space for accommodating the supply tank 558.

The generator accommodating portion 562 may be formed as a recess that is depressed in the bottom surface of the moisture supply body 551 toward the top surface of the moisture supply body 551, and the tank accommodating portion 561 may be formed as a recess that is depressed in the bottom surface of the air supply body 531 toward the top surface of the air supply body 531.

When the tank mounting portion 514*b* is located higher than the moisture generator 556 (i.e., water in the supply tank is supplied to the moisture generator without a pump), the height of the tank accommodating portion 561 needs to be set to be greater than the height of the generator accommodating portion 562.

The tank mounting portion 514*b* provided in the connection surface 514 forms a passage that penetrates the connection surface 514 to be connected to the tank accommodating portion 561, and the valve 558*b* of the supply tank 558 is coupled to the actuator 559*a* when the supply tank 558 is inserted into the tank accommodating portion 561 through the tank mounting portion 514*b*.

When the generator accommodating portion 562 is provided, the moisture supply pipe 557 may be provided so as to supply moisture through two opposite side surfaces of the generator accommodating portion 562 (i.e., the left surface and the right surface of the generator accommodating portion that extend in the height direction of the storage body). Accordingly, the amount of moisture supplied to the discharge holes 518 formed in the first support surface 511 and the amount of moisture supplied to the discharge holes 518 formed in the second support surface 512 may be similar to each other.

Figure 14:
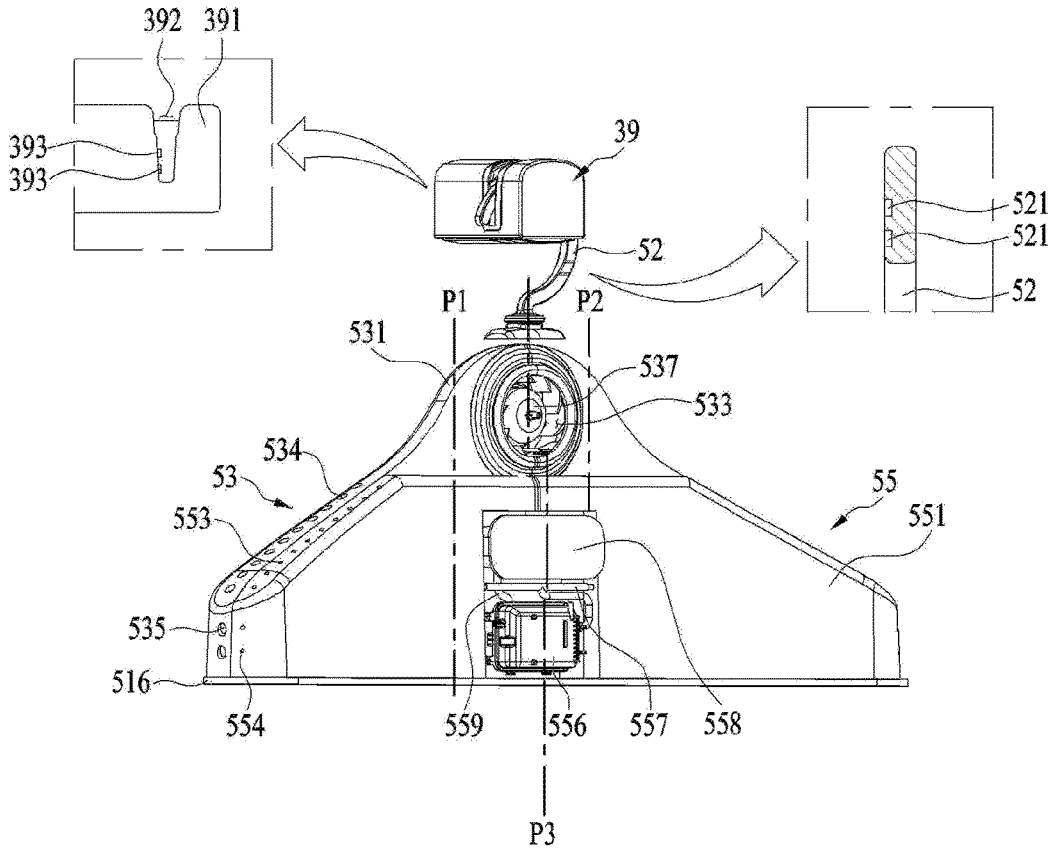
FIG. 14 shows examples of a fastening unit and a fastening-unit terminal provided at the hanger.

Referring to FIGS. 13 and 14, the impeller motor 537*b*, the heater 538 of the air supply unit, and the heater 556*b* of the moisture generator may receive power through a fastening-unit terminal 521 provided at the fastening unit 52.

As described above, the support body mounting portion 39, by which the hanger 5 as well as the cabinet hanger H is supported, may be provided on the door-chamber mounting surface 316. When the fastening unit 52 is provided so as to be secured to the support body mounting portion 39 provided in the door chamber, the support body mounting portion 39 may be provided with a support-bar terminal 393 that connects the fastening-unit terminal 521 to a power supply.

The support body mounting portion 39 may include a support bar 391 that is secured to the door-chamber mounting surface 316, and a mounting recess 392 that is formed in the support bar to allow the fastening unit 52 to be seated therein. The support-bar terminal 393 may be formed as a conductive element that is secured in the mounting recess 392 and is connected to the power supply, and the fastening-unit terminal 521 may be formed as a conductive element that is brought into contact with the support-bar terminal 393 when the fastening unit 52 is inserted into the mounting recess 392.

In order to independently use the hanger 5 separately from the laundry treating apparatus 100, a power connection line for supplying external power to the hanger 5 may be provided in the hanger 5 (or at the hanger 5).

The fastening unit 52 shown in FIG. 14 is formed in the shape of a hook that is secured to the base 513. Alternatively, the fastening unit 52 may be embodied as a fastening bar that protrudes from the base 513 toward the door-chamber mounting surface 316.

Meanwhile, referring to FIGS. 12 to 14, the moisture generator 556 may be located below the supply tank 558 while being spaced a predetermined distance apart from the supply tank 558. The reason for this is to prevent the water in the supply tank 558 from being unnecessarily heated by the heater 556*b* of the moisture generator. Additionally, the water stored in the supply tank may be prevented from being contaminated due to heating thereof.

The moisture generator 556 may be supported by the moisture supply body 551 or the support body 51 and located in the generator accommodating portion 562. The moisture generator 556 may be supported by the moisture supply body 551, rather than the support body 51, in terms of repair and disassembly of the hanger 5.

Meanwhile, the center of gravity of the hanger 5 having the above-described structure may vary when the amount of water stored in the supply tank 558 changes, when the amount of water stored in the moisture generator 556 changes, and/or when the rpm of the impeller 537*a* increases.

Unlike the illustration in FIG. 14, when the moisture generator 556 and the supply tank 558 are disposed in the horizontal direction (rather than the vertical direction) it may be difficult to maintain lateral balance of the hanger 5 because the weight of the moisture generator 556 and the weight of the supply tank 558 are different from each other.

Therefore, if the center of gravity of the hanger 5 does not remain constant, the laundry hung on the hanger 5 may rotate about the fastening unit 52 (i.e., the hanger may be inclined when the fastening unit has a hook shape), the durability of the fastening unit 52 or a mounting hole 394 may be deteriorated, and/or the hanger 5 may not receive power (when the fastening unit is of a fastening bar type).

The above-described laundry treating apparatus 100 enables the user to check laundry, an accessory, and/or the like accommodated in the door chamber 312 through the transparent body 342 of the second door 34 from the outside. However, if the hanger 5 is in an inclined state, and/or if the mounting hole 394 is damaged, the aesthetics of the laundry treating apparatus may be deteriorated.

In order to prevent the above problems, among the components of the hanger 5, relatively heavy components may be disposed such that the centers of the gravity thereof are located between a boundary P1 (a first boundary)

between the base 513 and the first support surface 511 and a boundary P2 (a second boundary) between the base 513 and the second support surface 512.

FIG. 14 illustrates an example in which the center of gravity of the fan 537, the center of gravity of the heater 538 of the air supply unit, the center of gravity of the moisture generator 556, and the center of gravity of the supply tank 558 are located between the first boundary P1 and the second boundary P2. In order to minimize change in the center of gravity of the hanger 5, the center of gravity of the fan 537, the center of gravity of the heater 538 of the air supply unit, the center of gravity of the moisture generator 556, and the center of gravity of the supply tank 558 may be located in a vertical line P3 that passes through a point at which the fastening unit 52 is secured to the base 513.

However, the structure shown in FIG. 14 is merely given by way of example. Only two or three of the center of gravity of the fan 537, the center of gravity of the heater 538 of the air supply unit, the center of gravity of the moisture generator 556, and the center of gravity of the supply tank 558 may be located between the first boundary P1 and the second boundary P2, and/or may be located in the vertical line P3. The reason for this is to enable the hanger 5 to be independently driven even when the fastening unit 52 is not fixedly hung, unlike what is illustrated in FIG. 14.

If the center of gravity of the hanger 5 is not located below the fastening unit, i.e. (between the first boundary P1 and the second boundary P2), but is located outside the region between the first boundary P1 and the second boundary P2, unnecessary torque is generated with respect to the fastening unit.

In order to prevent this, the center of gravity of the fan 537 and the center of gravity of the moisture generator 556 may be located between the first boundary P1 and the second boundary P2, and/or may be located in the vertical line P3.

Alternatively, the center of gravity of the moisture generator 556 and the center of gravity of the supply tank 558 may be located between the first boundary P1 and the second boundary P2, and/or may be located in the vertical line P3.

Alternatively, the center of gravity of the moisture generator 556, the center of gravity of the supply tank 558, and the center of gravity of the fan 537 may be located between the first boundary P1 and the second boundary P2, and/or may be located in the vertical line P3.

Alternatively, the center of gravity of the moisture generator 556, the center of gravity of the fan 537, and the center of gravity of the heater 538 of the air supply unit may be located between the first boundary P1 and the second boundary P2, or may be located in the vertical line P3.

Meanwhile, the center of gravity of the fan may be substituted with the center of rotation of the impeller.

The center of gravity of the fan 537 may be determined by the center of gravity of the impeller 537*a* and the center of gravity of the impeller motor 537*b*, and the center of gravity of the impeller motor 537*b* may not coincide with the center of rotation of the impeller 537*a*.

When the center of gravity of the impeller motor 537*b* does not coincide with the center of rotation of the impeller 537*a*, it is preferable for the center of rotation of the impeller 537*a* to be located between the first boundary P1 and the second boundary P2 or to be located in the vertical line P3. Considering the aesthetics of the hanger 5 (the position of the air intake hole) and the amount of air suctioned into the air intake hole 514*a* and distributed to the air exhaust holes 517 formed in each of the first support surface 511 and the second support surface 512, it is preferable to make the center of rotation of the impeller, rather than the center of gravity of the impeller motor, coincide with the center of gravity of another component.

That is, two or more of the center of rotation of the impeller 537*a*, the center of gravity of the heater 538 of the air supply unit, the center of gravity of the moisture generator 556, and the center of gravity of the supply tank 558 may be located between the first boundary P1 and the second boundary P2, and/or may be located in the vertical line P3.

Figure 15:
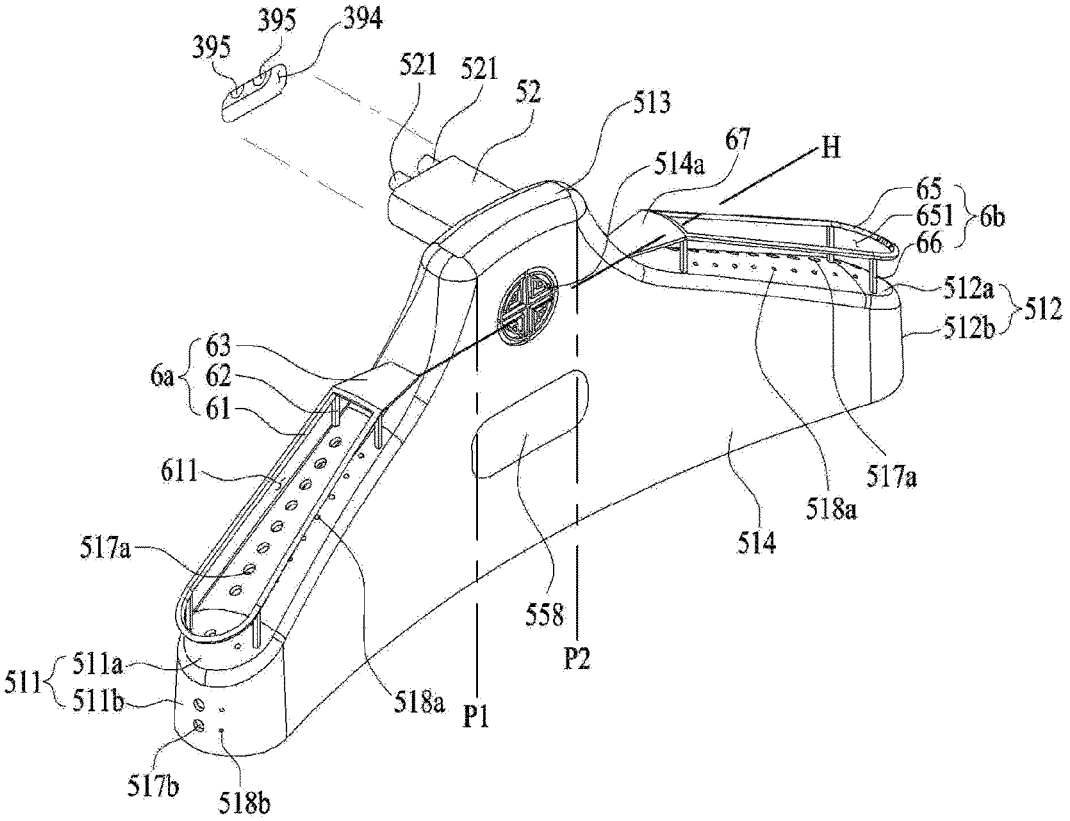
FIG. 15 shows another embodiment of the hanger.

FIG. 15 shows another example of the hanger 5 of the present disclosure. As shown in FIG. 15, when the fastening unit 52 is of a fastening bar type, the fastening-unit terminal 521 needs to be disposed on the free end of the fastening bar. In this example, the support body mounting portion 39 may include a mounting hole 394 that is formed in the door-chamber mounting surface 316 to receive the fastening bar inserted thereinto, and a door terminal 395 that is disposed in the mounting hole and is connected to the power supply.

Referring to FIGS. 7 and 15, it may be preferable for the air intake hole 514*a* to be located in a region in which suction of external air is disturbed as little as possible by laundry. For example, when the first upper support portion 63 and the second upper support portion 67 described above are provided, the air intake hole 514*a* may be located between the first upper support portion 63 and the second upper support portion 67.

In detail, the uppermost end of the air intake hole 514*a* may be located above a line H that interconnects the first upper support portion 63 and the second upper support portion 67, and the lowermost end of the air intake hole 514*a* may be located below the line H that interconnects the first upper support portion 63 and the second upper support portion 67.

Although not shown in the drawings, the center of the air intake hole 514*a* may be located in the horizontal line H that interconnects the first upper support portion 63 and the second upper support portion 67.

The reason for this is to prevent the heated air discharged from the first air exhaust holes 517*a* formed in the first top surface 511*a* and the second top surface 512*a* from being immediately suctioned into the air intake hole 514*a*. Additionally, it is possible to prevent the moisture or steam discharged from the first discharge holes 518*a* formed in the first top surface 511*a* and the second top surface 512*a* from being immediately suctioned into the air intake hole 514*a*. In addition, in order to prevent the water in the supply tank 558 from being unnecessarily heated, the heater 538 and the supply tank 558 need to be spaced apart from each other. Therefore, the air intake hole 514*a* is spaced apart from the supply tank 558, and it is possible to minimize heating of the region in which the fastening unit 52 is located.

Although not mentioned in the above-described embodiments, the cabinet hanger H may be hung on the support body mounting portion 39.

As is apparent from the above description, the present disclosure provides a hanger capable of supplying moisture or air (heated air or non-heated air) to laundry and a laundry treating apparatus including the hanger.

In addition, the present disclosure provides a hanger capable of being detachably mounted in a laundry treating apparatus and capable of independently supplying moisture or air to laundry even when the same is separated from the laundry treating apparatus.

In addition, the present disclosure provides a hanger capable of maintaining a horizontal orientation by minimizing change in the center of gravity thereof during supply of moisture to laundry and a laundry treating apparatus including the hanger.

In addition, the present disclosure provides a laundry treating apparatus including a cabinet chamber, which is provided in a cabinet to define a space for treatment of laundry, and a door chamber, which is provided in a door for opening or closing the cabinet chamber to define a space for treatment of laundry.

In addition, the present disclosure provides a hanger, which is provided in the cabinet chamber or the door chamber to define a space in which laundry is supported.

In addition, the present disclosure provides a hanger capable of preventing laundry from blocking an air exhaust hole for supplying air and a discharge hole for supplying moisture and a laundry treating apparatus including the hanger.

The structure of the hanger and the laundry treating apparatus described above and the control method thereof relate to particular embodiments, and thus the scope of the present application is not limited to the above-described embodiments.

What is claimed is:

1. A hanger comprising:

a support body that includes a base, a first support surface to extend from a first side of the base, a second support surface to extend from a second side of the base, and a connection surface to connect to the base and to the first and second support surfaces;

an air intake hole disposed at the connection surface, and configured to introduce air into the support body;

an air exhaust hole disposed at each of the first support surface and the second support surface to discharge air;

a discharge hole disposed at each of the first support surface and the second support surface to discharge moisture;

an air flow path provided at the support body to connect the air intake hole and the air exhaust hole;

a moisture flow path provided at the support body to connect to the discharge hole;

a fan configured to suction air through the air intake hole;

a moisture generator configured to provide steam to the moisture flow path;

a first spacer to secure to the support body, and configured to provide a laundry support space and to maintain a predetermined interval from the first support surface; and a second spacer to secure to the support body, and configured to provide a laundry support space and to maintain a predetermined interval from the second support surface, wherein the first spacer includes:

a first seating body configured to support laundry;

a first fixed portion configured to secure the first seating body to the first support surface; and a first-seating-body through-hole formed through the first seating body to allow fluid to pass therethrough, and wherein the second spacer includes:

a second seating body configured to support laundry;

a second fixed portion configured to secure the second seating body to the second support surface; and a second-seating-body through-hole formed through the second seating body to allow fluid to pass therethrough.

2. The hanger according to claim 1, wherein the first spacer includes:

a first upper support portion to connect an upper end of the first seating body to the first support surface, and configured to support a first part of laundry; and a second upper support portion to connect an upper end of the second seating body to the second support surface, and configured to support a second part of the laundry.

3. The hanger according to claim 2, wherein the air intake hole at the connection surface is disposed between the first upper support portion and the second upper support portion.

4. The hanger according to claim 1, wherein a size of the air exhaust hole is larger than a size of the discharge hole.

5. The hanger according to claim 1, wherein at least a portion of the air intake hole is disposed higher than the air exhaust hole.

6. The hanger according to claim 5, wherein at least the portion of the air intake hole is disposed higher than the discharge hole.

7. The hanger according to claim 1, wherein the fan is disposed closer to the air intake hole than to the air exhaust hole.

8. The hanger according to claim 1, wherein the fan is provided in the support body, and at least a portion of the fan is disposed higher than the air exhaust hole.

9. A hanger comprising:

a support body that includes a base a first support surface to extend from a first side of the base, a second support surface to extend from a second side of the base, and a connection surface to connect to the base and to the first and second support surfaces;

an air intake hole disposed at the connection surface, and configured to introduce air into the support body;

an air exhaust hole disposed at each of the first support surface and the second support surface to discharge air;

a discharge hole disposed at each of the first support surface and the second support surface to discharge moisture;

an air flow path provided at the support body to connect the air intake hole and the air exhaust hole;

a moisture flow path provided at the support body to connect to the discharge hole;

a fan configured to suction air through the air intake hole;

a moisture generator configured to provide steam to the moisture flow path;

a first spacer to secure to the support body, and configured to provide a laundry support space and to maintain a predetermined interval from the first support surface; and a second spacer to secure to the support body, and configured to provide a laundry support space and to maintain a predetermined interval from the second support surface, wherein the fan includes:

an impeller provided at the support body to suction external air to the air intake hole; and an impeller motor configured to rotate the impeller.

10. The hanger according to claim 9, comprising:

a heater provided at the support body, and configured to heat air that has passed through the air intake hole.

11. The hanger according to claim 10, wherein a center of gravity of the heater is vertically disposed between a first boundary between the base and the first support surface and a second boundary between the base and the second support surface.

12. The hanger according to claim 11, comprising:

a fastener is coupled to the base, and is configured to allow the support body to be detachably secured to an external device, wherein a first point is a point at which the fastener is secured to the base, a second point is at the center of gravity of the heater, a third point is at a center of gravity of the fan, and a fourth point is at a center of gravity of the moisture generator, and wherein the first point, the second point, the third point and the fourth point are disposed along a straight line.

13. The hanger according to claim 12, comprising:

a fastener terminal provided at the fastener and configured to connect to a power supply in order to supply power to the impeller motor, the moisture generator, and the heater.

14. The hanger according to claim 13, comprising:

a supply tank to be removably provided at the support body, and configured to store a liquid, wherein the supply tank is connected to the moisture generator when the supply tank is secured to the support body, and wherein a center of gravity of the supply tank is vertically disposed between a first boundary between the base and the first support surface and a second boundary between the base and the second support surface.

15. The hanger according to claim 14, wherein the first support surface includes:

a first top surface to secure to the base, and configured to support a first part of laundry; and a first side surface to extend from the first top surface, and wherein the second support surface includes:

a second top surface to secure to the base, and configured to support a second part of the laundry; and a second side surface to extend from the second top surface.

16. The hanger according to claim 15, wherein the air exhaust hole includes:

a first air exhaust hole disposed at each of the first top surface and the second top surface; and a second air exhaust hole disposed at each of the first side surface and the second side surface.

17. The hanger according to claim 16, wherein the discharge hole includes:

a first discharge hole disposed at each of the first top surface and the second top surface; and a second discharge hole disposed at each of the first side surface and the second side surface.

18. The hanger according to claim 17, wherein the support body includes:

a bottom surface connecting the first side surface, the second side surface, and the connection surface.

19. The hanger according to claim 18, wherein the air exhaust hole includes a third air exhaust hole disposed at the bottom surface, and wherein the discharge hole includes a third discharge hole disposed at the bottom surface.

20. The hanger according to claim 19, comprising:

an air supply body at the support body, and configured to have the air flow path;

an air-intake-hole connection portion disposed at the air supply body, and configured to connect the air intake hole to the air flow path;

a first air-exhaust-hole communication hole disposed at the air supply body, and configured to connect the air flow path to the first air exhaust hole;

a second air-exhaust-hole communication hole configured to connect the air flow path to the second air exhaust hole; and a third air-exhaust-hole communication hole configured to connect the air flow path to the third air exhaust hole.

21. The hanger according to claim 20, comprising:

a moisture supply body at the support body, and configured to have the moisture flow path;

a first discharge-hole communication hole disposed at the moisture supply body, and configured to connect the moisture flow path to the first discharge hole;

a second discharge-hole communication hole configured to connect the moisture flow path to the second discharge hole; and a third discharge-hole communication hole configured to connect the moisture flow path to the third discharge hole.

22. The hanger according to claim 21, wherein the moisture supply body includes a generator accommodating portion to accommodate the moisture generator;

wherein the air supply body includes a tank accommodating portion to accommodate the supply tank; and a tank mounting portion disposed at the connection surface to allow the supply tank to be inserted into the tank accommodating portion.

23. The hanger according to claim 22, comprising:

a drain hole configured to discharge the liquid in the supply tank;

a check valve configured to control opening and closing of the drain hole; and a supply flow path associated with an actuator configured to operate the check valve to open the drain hole when the supply tank is inserted into the tank accommodating portion, a connection pipe to connect the actuator to the moisture generator, and a connection-pipe valve configured to control opening and closing of the connection pipe.

24. The hanger according to claim 9, wherein the moisture generator is disposed at the support body at a position lower than the fan.

25. The hanger according to claim 9, wherein a center of gravity of the fan is vertically disposed between a first boundary between the base and the first support surface and a second boundary between the base and the second support surface, and a center of gravity of the moisture generator is vertically disposed between the first boundary and the second boundary.

26. A hanger comprising:

a support body that includes a base, a first support surface to extend from a first side of the base, a second support surface to extend from a second side of the base, and a connection surface to connect to the base and to the first and second support surfaces;

an air intake hole disposed at the connection surface, and configured to introduce air into the support body;

an air exhaust hole disposed at each of the first support surface and the second support surface to discharge air;

a discharge hole disposed at each of the first support surface and the second support surface to discharge moisture;

an air flow path provided at the support body to connect the air intake hole and the air exhaust hole;

a moisture flow path provided at the support body to connect to the discharge hole;

a fan configured to suction air through the air intake hole;

a moisture generator configured to provide steam to the moisture flow path;

a first spacer to secure to the support body and configured to provide a laundry support space and to maintain a predetermined interval from the first support surface; and a second spacer to secure to the support body, and configured to provide a laundry support space and to maintain a predetermined interval from the second support surface, wherein the air exhaust hole through each of the first support surface and the second support surface is provided in a plurality thereof, wherein the discharge hole through each of the first support surface and the second support surface is provided in a plurality thereof, wherein the plurality of air exhaust holes disposed through the first support surface is arranged parallel to the plurality of discharge holes disposed through the first support surface in a direction from the first support surface toward the base, and wherein the plurality of air exhaust holes disposed through the second support surface is arranged parallel to the plurality of discharge holes disposed through the second support surface in a direction from the second support surface toward the base.

27. A hanger comprising:

a support body that includes a base, a first support surface to extend from a first side of the base, a second support surface to extend from a second side of the base, and a connection surface to connect to the base and to the first and second support surfaces;

an air intake hole disposed at the connection surface, and configured to introduce air into the support body;

an air exhaust hole disposed at each of the first support surface and the second support surface to discharge air;

a discharge hole disposed at each of the first support surface and the second support surface to discharge moisture;

an air flow path provided at the support body to connect the air intake hole and the air exhaust hole;

a moisture flow path provided at the support body to connect to the discharge hole;

a fan configured to suction air through the air intake hole;

a moisture generator configured to provide steam to the moisture flow path;

a first spacer to secure to the support body, and configured to provide a laundry support space and to maintain a predetermined interval from the first support surface; and a second spacer to secure to the support body, and configured to provide a laundry support space and to maintain a predetermined interval from the second support surface, wherein the connection surface includes a first connection surface and a second connection surface connecting the base to the first support surface and to the second support surface to respectively form a front surface and a rear surface of the support body.

28. The hanger according to claim 27, wherein the air intake hole is to pass through the first connection surface.

29. The hanger according to claim 27, wherein the air exhaust hole is disposed closer to the first connection surface than the discharge hole.

30. A laundry treating apparatus comprising:

a cabinet including a cabinet chamber configured to define a space for receiving laundry and a cabinet inlet configured to allow the cabinet chamber to communicate with an outside;

a supply device configured to provide at least one of air or steam to the cabinet chamber;

a first door configured to open or close the cabinet inlet;

a door chamber provided at the first door, and configured to define a space for receiving laundry;

a second door configured to open or close the door chamber; and a hanger to be removably provided in the cabinet chamber or the door chamber, wherein the hanger comprises:

a support body that includes a base, a first support surface to extend from a first side of the base, a second support surface to extend from a second side of the base, and a connection surface to connect to the base and to the first and second support surfaces;

a fastener to couple to an upper portion of the support body and configured to hang the support body;

an air intake hole disposed at the connection surface and configured to introduce air into the support body;

an air exhaust hole disposed at each of the first support surface and the second support surface to discharge air;

a discharge hole disposed at each of the first support surface and the second support surface to discharge moisture;

an air flow path provided at the support body to connect the air intake hole and the air exhaust hole;

a moisture flow path provided at the support body to connect to the discharge hole;

a fan configured to suction air through the air intake hole;

a moisture generator configured to provide steam to the moisture flow path;

a first spacer to secure to the support body, and configured to provide a laundry support space and to maintain a predetermined interval from the first support surface; and a second spacer to secure to the support body, and configured to provide a laundry support space and to maintain a predetermined interval from the second support surface.

* * * * *